US010408151B2

(12) United States Patent
Hotta et al.

(10) Patent No.: US 10,408,151 B2
(45) Date of Patent: Sep. 10, 2019

(54) CONTROL DEVICE

(71) Applicants: DENSO CORPORATION, Kariya-shi, Aichi (JP); YAMAHA HATSUDOKI KABUSHIKI KAISHA, Iwata-shi, Shizuoka (JP)

(72) Inventors: Minoru Hotta, Kariya (JP); Yoshihiko Nonogaki, Kariya (JP); Kazuteru Iwamoto, Iwata (JP); Makoto Wakimura, Iwata (JP); Naoki Nagata, Kariya (JP)

(73) Assignees: DENSO CORPORATION, Kariya-shi, Aichi (JP); YAMAHA HATSUDOKI KABUSHIKI KAISHA, Iwata-shi, Shizuoka (JP)

( * ) Notice: Subject to any disclaimer, the term of this patent is extended or adjusted under 35 U.S.C. 154(b) by 0 days.

(21) Appl. No.: 15/829,920

(22) Filed: Dec. 2, 2017

(65) Prior Publication Data

US 2018/0087462 A1 Mar. 29, 2018

Related U.S. Application Data

(63) Continuation-in-part of application No. PCT/JP2016/066206, filed on Jun. 1, 2016.

(30) Foreign Application Priority Data

Jun. 2, 2015 (JP) ..... 2015-111921

(51) Int. Cl.

| | |
|---|---|
| ***F02D 41/14*** | (2006.01) |
| ***F02D 41/22*** | (2006.01) |
| ***F02D 45/00*** | (2006.01) |
| ***F02B 77/08*** | (2006.01) |
| ***F02B 75/02*** | (2006.01) |
| ***F02D 41/00*** | (2006.01) |
| ***G07C 5/08*** | (2006.01) |
| *F02B 61/02* | (2006.01) |
| *F02D 41/28* | (2006.01) |

(52) U.S. Cl.

CPC ..... *F02D 41/1498* (2013.01); *F02B 75/02* (2013.01); *F02B 77/08* (2013.01); (Continued)

(58) Field of Classification Search

CPC ..... F02D 41/1498; F02D 41/0097; F02D 41/1497; F02D 41/22; F02D 45/00; (Continued)

(56) References Cited

U.S. PATENT DOCUMENTS 5,379,634 A * 1/1995 Kuroda ..... G01M 15/11 73/114.04
5,747,681 A 5/1998 Kuroda et al.
(Continued)

FOREIGN PATENT DOCUMENTS

DE 19610580 A1 9/1997
DE 102013220413 A1 4/2015
(Continued)

*Primary Examiner* — Mahmoud Gimie
(74) *Attorney, Agent, or Firm* — Rabin & Berdo, P.C.

(57) ABSTRACT

A control device for a rotating element rotated by a four-stroke engine has a high degree of freedom in the choice of an apparatus to which the control device is applicable. The control device includes a rotation speed acquisition unit configured to obtain a rotation speed of the rotating element rotated by the four-stroke engine, and an undulation detection unit configured to, based on the rotation speed obtained by the rotation speed acquisition unit, detect a periodic undulation contained in a rotation fluctuation of the four-stroke engine, the periodic undulation having an angular period longer than a crank angle corresponding to four strokes.

16 Claims, 9 Drawing Sheets

(52) U.S. Cl.
CPC ..... *F02D 41/0097* (2013.01); *F02D 41/1497* (2013.01); *F02D 41/22* (2013.01); *F02D 45/00* (2013.01); *G07C 5/0825* (2013.01); *F02B 61/02* (2013.01); *F02B 2075/027* (2013.01); *F02D 2041/286* (2013.01); *F02D 2200/101* (2013.01); *F02D 2200/1015* (2013.01)

(58) Field of Classification Search
CPC ..... F02D 2041/286; F02D 2200/101; F02D 2200/1015; F02B 75/02; F02B 77/08; F02B 61/02; F02B 2075/027; G07C 5/0825
USPC ..... 701/110
See application file for complete search history.

(56) References Cited

U.S. PATENT DOCUMENTS

| | | | | |
|---|---|---|---|---|
| 5,875,411 | A * | 2/1999 | Volkart | G01M 15/11 123/436 |
| 5,893,897 | A * | 4/1999 | Volkart | G01M 15/046 123/436 |
| 7,032,439 | B2 * | 4/2006 | Lee | G01M 15/11 73/114.04 |
| 2002/0014113 | A1 | 2/2002 | Takaku et al. | |
| 2002/0056315 | A1 | 5/2002 | Takaku et al. | |
| 2004/0122585 | A1 * | 6/2004 | Aono | G01M 15/11 701/111 |
| 2004/0144165 | A1 * | 7/2004 | Yamada | G01M 15/11 73/114.06 |
| 2007/0157713 | A1 | 7/2007 | Tsukamoto et al. | |
| 2010/0031736 | A1 * | 2/2010 | Kushihama | G01M 15/11 73/114.04 |

FOREIGN PATENT DOCUMENTS

| | | | |
|---|---|---|---|
| EP | 0429819 | A1 | 6/1991 |
| JP | H04-365958 | A | 12/1992 |
| JP | H07-119536 | A | 5/1995 |
| JP | H07-217489 | A | 8/1995 |
| JP | H11-013531 | A | 1/1999 |
| JP | 2002-122037 | A | 4/2002 |
| JP | 2007-198368 | A | 8/2007 |
| JP | 2009-008057 | A | 1/2009 |
| TW | 201120303 | A | 6/2011 |

* cited by examiner

CONTROL DEVICE

CROSS-REFERENCE TO RELATED APPLICATIONS

This is a continuation-in-part application of International Application PCT/JP2016/066206, filed on Jun. 1, 2016, which is based on, and claims priority to, Japanese Patent Application No. 2015-111921, filed on Jun. 2, 2015. The contents of each of the identified applications is incorporated herein by reference.

TECHNICAL FIELD

The present teaching relates to a control device for a rotating element rotated by a four-stroke engine.

BACKGROUND ART

Examples of a conventional control device for a rotating element rotated by a four-stroke engine include a misfire detection device for an internal combustion engine disclosed in Patent Literature 1 (PTL 1) (identified further on). The misfire detection device for the internal combustion engine obtains an average rotation frequency $\omega_n$ in explosion strokes of respective cylinders, based on outputs of a rotation angle sensor. Then, the device sets an average rotation frequency fluctuation amount $\Delta\omega_n$ by obtaining a deviation (first fluctuation amount ($\omega_{n-1}$-$\omega_n$)) between average rotation frequencies $\omega_n$ in respective cylinders in which the explosion stroke successively occurs, and a deviation (second fluctuation amount ($\omega_{n-4}$-$\omega_{n-3}$)) between average rotation frequencies in respective successive cylinders at a rotation angle position 360°CA (crank angle) before. Then, the device determines a misfire based on the average rotation frequency fluctuation amount $\Delta\omega_n$.

PTL 1: Japanese Patent Application Laid-Open No. H4-365958 (1992)

SUMMARY

The conventional misfire detection device as disclosed in Patent Literature 1, however, involves a problem that, if the four-stroke engine which is a misfire detection target is mounted to a motorcycle, for example, appropriate determination of a misfire may be difficult even while a motorcycle is traveling not on a rough road but on a flat road. Thus, depending on the kind of apparatus (vehicle, etc.) to which the four-stroke engine is mounted, application of the conventional control device to the apparatus may be difficult. Thus, there has been a problem that a degree of freedom in the choice of an apparatus to which the control device is applicable is restricted.

The present teaching aims to provide a control device for a rotating element rotated by a four-stroke engine, having a high degree of freedom in the choice of an apparatus to which the control device is applicable.

The present teaching discloses the following configurations.

According to a first aspect, the configurations may comprise a control device for a rotating element that is rotated by a four-stroke engine, the control device including a rotation speed acquisition unit configured to obtain a rotation speed of the rotating element rotated by the four-stroke engine, and an undulation detection unit configured to, based on a rotation speed obtained by the rotation speed acquisition unit, detect a periodic undulation contained in a rotation fluctuation of the four-stroke engine, the periodic undulation having an angular period longer than a crank angle corresponding to four strokes.

The control device can detect a periodic undulation contained in the rotation speed of the four-stroke engine based on the rotation speed of the rotating element rotated by the four-stroke engine, the periodic undulation having an angular period longer than the crank angle corresponding to four strokes. Accordingly, a rotation fluctuation attributable to combustion of the four-stroke engine can be obtained by, for example, removal of the periodic undulation having an angular period longer than the crank angle corresponding to four strokes from the rotation speed of the four-stroke engine. As a result, for example, the rotating element (a wheel, a crank shaft, etc.) rotated by the four-stroke engine can be diagnosed while an influence of the periodic undulation is suppressed. In the diagnosis, for example, detection of the presence or absence of a misfire in the engine, detection of whether or not the wheel balance is proper, detection of whether or not the air pressure of a wheel is proper, and the like, can be made. The control device of the present teaching, which suppresses the influence of the periodic undulation, is applicable to an apparatus in which a periodic undulation can occur. The control device of the present teaching has a high degree of freedom in the choice of an apparatus to which it is applicable.

The inventors of the present teaching conducted studies on the above-described problems, to find out the following.

A rotation fluctuation of a four-stroke engine mounted to an apparatus (e.g., a vehicle such as a motorcycle) contains, for example, a fluctuation not associated with the crank angle speed of the engine and a fluctuation associated with the crank angle speed of the engine. Examples of the fluctuation not associated with the crank angle speed of the engine include: acceleration or deceleration of the four-stroke engine caused by operation of the apparatus; and a change of the rotation speed of the four-stroke engine attributable to a change of an external load on the apparatus. Examples of the change of the external load on the apparatus include a change of a load applied to the four-stroke engine of the vehicle while the vehicle is traveling on a rough road. Examples of the fluctuation associated with the crank angle speed of the engine include uneven combustion, a deviation of a cylinder, and a tolerance of a crank angle speed sensor or a detection object portion of the sensor.

The rotation speed of the four-stroke engine detected by the crank angle speed sensor normally contains rotation fluctuations attributable to various factors as mentioned above. The conventional control device as disclosed in Patent Literature 1 enables determination of the presence or absence of a misfire, or the like, to be diagnosed while suppressing an influence of the rotation fluctuations attributable to the above-mentioned factors.

Depending on the kind of apparatus to which the four-stroke engine is mounted, the fluctuation associated with the crank angle speed of the engine may include a fluctuation other than the above-described one. In a motorcycle, for example, not only a fluctuation attributable to an internal factor of the engine, such as uneven combustion, a deviation of a cylinder, and a tolerance of a crank angle speed sensor or a detection object portion of the sensor, but also a fluctuation attributable to an external factor of the engine, such as the structure of the motorcycle, may occur as the fluctuation associated with a crank angle speed of the engine. Thus, depending on the kind of apparatus (vehicle, etc.) to which the four-stroke engine is mounted, application of the conventional control device may be difficult.

In this respect, the inventors of the present teaching conducted studies on the fluctuation attributable to the external factor of the engine. The inventors of the present teaching found out that a rotation fluctuation of a four-stroke engine mounted to a motorcycle or the like contains a periodic undulation having an angular period longer than the crank angle corresponding to four strokes. The inventors of the present teaching further found out that this periodic undulation contained in the rotation fluctuation of the four-stroke engine makes it difficult for the conventional control device to, for example, appropriately diagnose determination of the presence or absence of a misfire in the four-stroke engine provided in the motorcycle or the like.

The present teaching is a teaching accomplished based on the findings above.

The control device of the present teaching detects the periodic undulation based on the rotation speed of the rotating element rotated by the four-stroke engine. Detection of the periodic undulation is not based on the torque of the four-stroke engine. Detection of the periodic undulation is not based on the traveling speed of a vehicle equipped with the four-stroke engine. Detection of the periodic undulation is not based on the amount of change in vehicle height of a vehicle equipped with the four-stroke engine. Detection of the periodic undulation is not based on the pressure in a combustion chamber of the four-stroke engine. Detection of the periodic undulation is not based on the temperature in a combustion chamber of the four-stroke engine. Detection of the periodic undulation may be based only on the rotation speed of the rotating element rotated by the four-stroke engine as illustrated in later-described embodiments.

The rotating element is rotated by the four-stroke engine. The rotating element may not necessarily be configured to receive a driving force directly from the four-stroke engine. It may be acceptable that the rotating element indirectly receives a driving force from the four-stroke engine via a mechanism other than the four-stroke engine. Examples of the rotating element include a crankshaft, a wheel, a gear, and a propeller.

The undulation as recited in the present teaching is in the form of a wave. The angular period of the undulation of the present teaching corresponds to the wavelength of the wave. For example, in a case where a rotation fluctuation varies up and down across the average value of the rotation speed so that a plurality of sets of up-and-down variations form one pattern, the wavelength corresponds to each of the up-and-down variations included in the pattern. In this case, the angular period of the undulation is not the length corresponding to the pattern but the length corresponding to each up-and-down variation.

The control device may not necessarily be configured to detect the periodic undulation alone. The control device of the present teaching may be configured to detect a fluctuation (for example, a fluctuation attributable to acceleration or deceleration of the engine, etc.) that is contained in the rotation fluctuation of the four-stroke engine and other than the periodic undulation, as illustrated in later-described embodiments. That is, the control device may be configured to detect a fluctuation not having an angular period.

The control device, for example, may include a combustion control unit for controlling operations of the four-stroke engine, or may be an apparatus other than an apparatus for controlling operations of the engine.

It suffices that the control device detects a periodic undulation having an angular period longer than the crank angle corresponding to four strokes. The control device may simply output a detection result to the outside. The control device may output a detection result of the periodic undulation as information indicating a structural state of an apparatus equipped with the four-stroke engine. The control device may, for example, output a detection result of the periodic undulation as information indicating an extension and compression state of suspension of a vehicle equipped with the four-stroke engine. The control device may output a detection result of the periodic undulation as information indicating a functional abnormality. The control device may, for example, output a detection result of the periodic undulation as information indicating an abnormal balance of wheels or an abnormal air pressure of wheels of a vehicle equipped with the four-stroke engine.

According to a second aspect, the configurations may comprise the control device according to the first aspect, in which the control device further includes an undulation removal unit configured to remove the periodic undulation detected by the undulation detection unit from a rotation speed of the four-stroke engine obtained based on a rotation speed of the rotating element.

The control device according to the second aspect removes the periodic undulation from the rotation speed of the four-stroke engine. Accordingly, a function that utilizes a rotation fluctuation other than the periodic undulation, such as a diagnosis function, can be applied to an apparatus in which the periodic undulation can occur.

The removal of the periodic undulation includes zeroing a component of the periodic undulation contained in the rotation speed of the engine. The removal of the periodic undulation includes reducing a component of a long-period undulation as compared with before the removal.

According to a third aspect, the configurations may comprise the control device according to the first aspect or the second aspect, in which the undulation detection unit is configured to detect the periodic undulation by repeatedly calculating an average rotation speed of the four-stroke engine in a (360×m)-degree crank angle zone, where m represents a natural number, based on a rotation speed obtained by the rotation speed acquisition unit.

The control device according to the third aspect calculates the average rotation speed in a period over which the rotating crankshaft returns to the original position. This can reduce an influence of a tolerance of the rotation position of the crankshaft. Accordingly, the periodic undulation can be detected with an increased accuracy.

According to a fourth aspect, the configurations may comprise the control device according to the third aspect, in which the undulation detection unit is configured to detect the periodic undulation by repeatedly calculating an average rotation speed of the four-stroke engine in a 360-degree crank angle zone based on a rotation speed obtained by the rotation speed acquisition unit.

The control device according to the fourth aspect makes it more likely to detect an undulation having a longer period when compared with when calculation is made in a zone other than the 360-degree crank angle zone.

According to a fifth aspect, the configurations may comprise the control device according to the third aspect, in which the undulation detection unit is configured to detect the periodic undulation by repeatedly calculating an average rotation speed of the four-stroke engine in a 720-degree crank angle zone based on a rotation speed obtained by the rotation speed acquisition unit.

The control device according to the fifth aspect calculates the average rotation speed with respect to a rotation corresponding to one cycle of the four-stroke engine. This can reduce an error which may otherwise be caused by a difference in strokes included in a calculation zone. Accordingly, the periodic undulation can be detected with an increased accuracy.

According to a sixth aspect, the configurations may comprise the control device according to the third aspect, in which the undulation detection unit is configured to detect the periodic undulation by repeatedly calculating an average rotation speed of the four-stroke engine in a (360×m)-degree crank angle zone and detect the periodic undulation by repeatedly calculating an average rotation speed of the four-stroke engine in a (360×n)-degree crank angle zone, where n represents a natural number different from m, based on a rotation speed obtained by the rotation speed acquisition unit.

The control device according to the sixth aspect detects the periodic undulation by calculating average rotation speeds in different zones. Since the periodic undulation is detected under different conditions, a wider range of the periodic undulation can be detected.

According to a seventh aspect, the configurations may comprise the control device according to any one of the first to sixth aspects, in which the undulation detection unit is configured to detect a component of the periodic undulation at a detection target crank angle position, based on a rotation speed in a range from a crank angle position before the detection target crank angle position to a crank angle position after the detection target crank angle position, the rotation speed being obtained by the rotation speed acquisition unit.

With the control device according to the seventh aspect, an undulation contained in the rotation speed obtained by the rotation speed acquisition unit is less phase-shifted relative to an undulation obtained by the undulation detection unit, when compared on the basis of the same crank angle position. Accordingly, the control device according to the seventh aspect is able to detect an undulation more accurately.

According to an eighth aspect, the configurations may comprise the control device according to any one of the first to seventh aspects, in which the rotation speed acquisition unit is configured to obtain a rotation speed of the rotating element included in a vehicle, the rotating element being rotated by the four-stroke engine that is provided in the vehicle so as to drive the vehicle, and the undulation detection unit is configured to detect the periodic undulation contained in a rotation speed of the four-stroke engine provided in the vehicle, based on a rotation speed obtained by the rotation speed acquisition unit.

The control device according to the eighth aspect is able to detect the periodic undulation that is contained in the rotation speed of the four-stroke engine and associated with the structure of the vehicle. Therefore, for example, the rotating element rotated by the four-stroke engine can be diagnosed while an influence of the periodic undulation is suppressed. In the diagnosis, for example, detection of the presence or absence of a misfire in the engine, detection of whether or not the wheel balance is proper, detection of whether or not the air pressure of the wheel is proper, and the like, can be made. The control device according to the eighth aspect, which suppresses the influence of the periodic undulation, is applicable to a vehicle having such a structure that the periodic undulation can occur.

According to a ninth aspect, the configurations may comprise the control device according to the eighth aspect, in which the rotation speed acquisition unit is configured to obtain a rotation speed of the rotating element rotated by the four-stroke engine that is provided in the vehicle so as to drive a wheel of the vehicle, and the undulation detection unit is configured to detect the periodic undulation contained in a rotation speed of the four-stroke engine that drives the wheel, based on a rotation speed obtained by the rotation speed acquisition unit.

The control device according to the ninth aspect is able to detect the periodic undulation that is contained in the rotation speed of the four-stroke engine and associated with the structure of the vehicle including the wheel. The control device according to the ninth aspect, which suppresses an influence of the periodic undulation, is applicable to a vehicle including a wheel in which the periodic undulation is likely to occur.

According to a tenth aspect, the configurations may comprise the control device according to the ninth aspect, in which the rotation speed acquisition unit is configured to obtain a rotation speed of the rotating element rotated by the four-stroke engine for driving the wheel that is supported by a suspension of the vehicle so as to be swingable in a vertical direction about a shaft extending in a lateral direction of a vehicle body of the vehicle, and the undulation detection unit is configured to detect the periodic undulation contained in a rotation speed of the four-stroke engine for driving the wheel that is supported to the vehicle body in a front-rear direction so as to be swingable in the vertical direction by the suspension, based on a rotation speed obtained by the rotation speed acquisition unit.

The control device according to the tenth aspect is able to detect the periodic undulation that is contained in the rotation speed of the four-stroke engine and associated with the wheel that is supported by the suspension so as to be swingable in the vertical direction about the shaft extending in the lateral direction of the vehicle body. The control device according to the tenth aspect, which suppresses an influence of the periodic undulation, is applicable to a vehicle including a wheel that is swingably supported by a suspension in which the periodic undulation can occur.

According to an eleventh aspect, the configurations may comprise the control device according to any one of the first to tenth aspects, in which the control device further includes at least one misfire determination unit configured to determine the presence or absence of a misfire in the four-stroke engine based on a rotation fluctuation attributable to combustion of the four-stroke engine, the rotation fluctuation being obtained by removal of a periodic undulation detected by the undulation detection unit from a rotation speed of the four-stroke engine.

The control device according to the eleventh aspect determines the presence or absence of a misfire in the four-stroke engine, based on the rotation fluctuation attributable to combustion of the four-stroke engine. The presence or absence of a misfire is determined based on the rotation fluctuation obtained by removal of the periodic undulation. Since an influence of the periodic undulation is suppressed, the accuracy of misfire determination is improved.

According to a twelfth aspect, the configurations may comprise the control device according to the eleventh aspect, in which the at least one misfire determination unit includes two misfire determination units configured to determine the presence or absence of a misfire in the four-stroke engine based on rotation fluctuations in different crank angle zones, respectively, and the two misfire determination units determine the presence or absence of a misfire in the four-stroke engine based on rotation fluctuations each obtained by removal of a periodic undulation from a rotation speed of the four-stroke engine, the periodic undulation being detected by the undulation detection unit calculating the average rotation speed in the same crank angle zone.

With the control device according to the twelfth aspect, the presence or absence of a misfire, which is an internal factor of the engine, is determined under different conditions, and thus the accuracy of misfire determination is increased. The presence or absence of a misfire is determined based on rotation fluctuations that are obtained by removal of a periodic undulation under the same condition. Since the same condition is adopted for the periodic undulation which is an external factor of the engine while different conditions are adopted for determination of the presence or absence of a misfire, the presence or absence of a misfire can be determined with a further improved accuracy.

In an example, the control device may include a first misfire determination unit configured to determine the presence or absence of a misfire based on a change of the amount of fluctuation in the rotation speed obtained by removal of a periodic undulation after passing a first crank angle zone, and a second misfire determination unit configured to determine the presence or absence of a misfire based on a change of the amount of fluctuation in the rotation speed obtained by removal of a periodic undulation after passing a second crank angle zone different from the first crank angle zone.

In an example, of the control device the rotation speed acquisition unit may be configured to obtain a rotation speed of the rotating element rotated by the four-stroke engine, by using a crank angle as a reference of an acquisition timing, and the undulation detection unit may be configured to detect the periodic undulation, based on a rotation speed obtained by the rotation speed acquisition unit with use of the crank angle as a reference.

ADVANTAGEOUS EFFECTS OF INVENTION

The present teaching can provide a control device for a rotating element rotated by a four-stroke engine, having a high degree of freedom in the choice of an apparatus to which the control device is applicable.

DETAILED DESCRIPTION

In the following, embodiments of the present teaching will be described with reference to the drawings.

Figure 1:
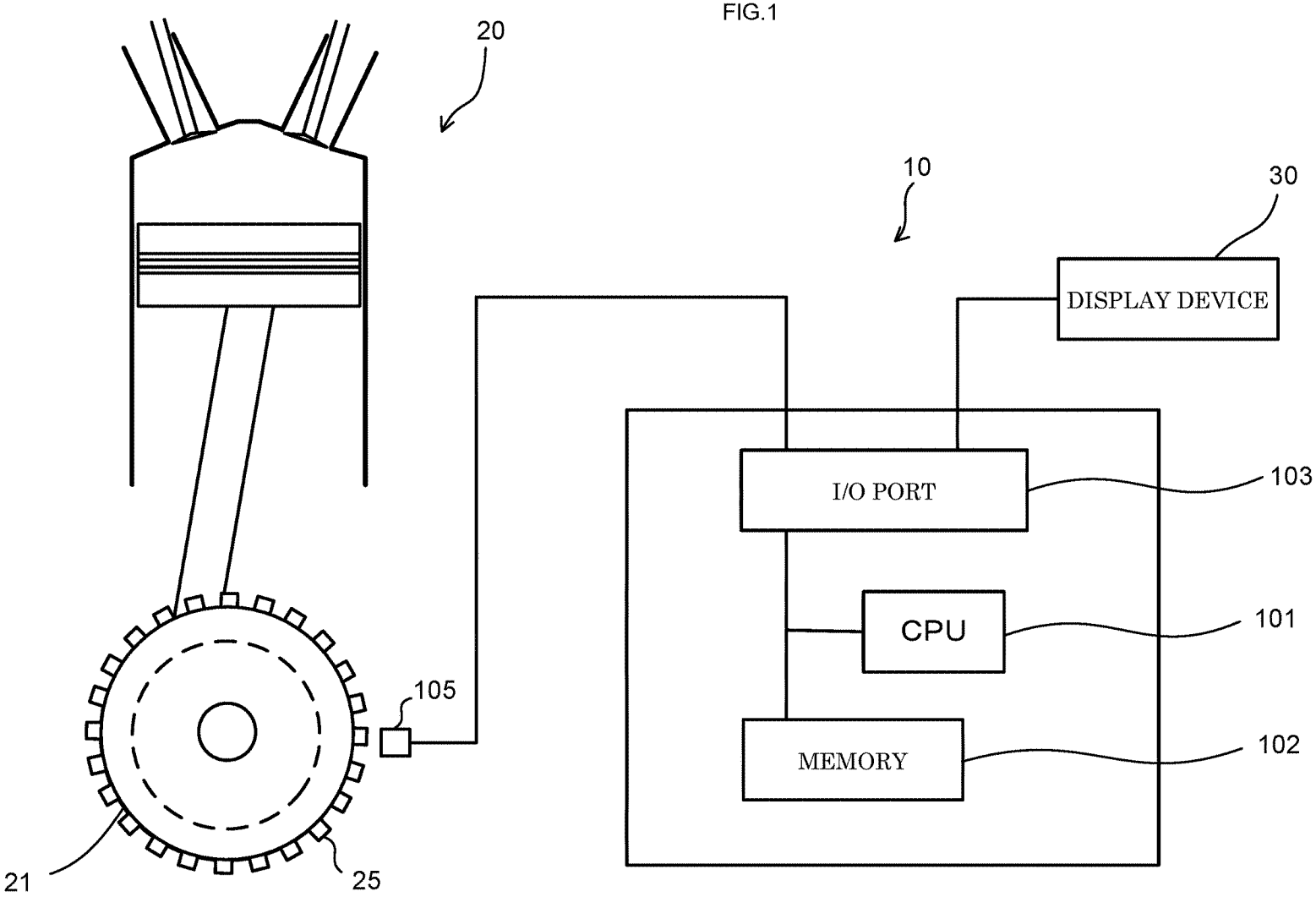
FIG. 1 shows a configuration diagram schematically showing a configuration of a control device and its peripheral devices according to a first embodiment of the present teaching.

FIG. 1 is a configuration diagram schematically showing a configuration of a control device and its peripheral devices according to a first embodiment of the present teaching.

[Control Device]

A control device 10 shown in FIG. 1 is a device for a four-stroke engine 20. The four-stroke engine 20 (which may also be referred to simply as engine 20) is provided in a motorcycle 50 shown in FIG. 9, for example. The engine 20 drives the motorcycle 50, and more specifically, drives a wheel 52 of the motorcycle 50.

The engine 20 of this embodiment is a three-cylinder engine. FIG. 1 shows a configuration corresponding to one cylinder. Here, a single-cylinder engine or a two-cylinder engine is also adoptable as the engine 20. An engine with four or more cylinders is also adoptable.

The engine 20 includes a crankshaft 21. The crankshaft 21 corresponds to an example of a rotating element of the present teaching. The crankshaft 21 is rotated in accordance with an operation of the engine 20. That is, the crankshaft 21 is rotated by the engine 20. The crankshaft 21 is provided with a plurality of detection object portions 25 for detection of rotation of the crankshaft 21. The detection object portions 25 are arranged in a circumferential direction of the crankshaft 21 and spaced at predetermined detection-angle intervals when viewed from the rotation center of the crankshaft 21. The detection angle is, for example, 15 degrees. The detection object portions 25 move along with rotation of the crankshaft 21.

The control device 10 includes a CPU 101, a memory 102, and an I/O port 103.

The CPU 101 executes arithmetic processing based on a control program. The memory 102 stores the control program and information necessary for arithmetic operations. The I/O port 103 inputs and outputs signals to and from external devices.

The I/O port 103 is connected to a rotation sensor 105 for detecting rotation of the crankshaft 21. The rotation sensor 105 is a sensor for obtaining the rotation speed of the crankshaft 21 of the engine 20. Upon detection of passing of the detection object portion 25, the rotation sensor 105 outputs a signal. The rotation sensor 105 outputs a signal each time the crankshaft 21 of the engine 20 is rotated through the detection angle.

The I/O port 103 is also connected to a display device 30. The display device 30 displays information outputted from the control device 10.

The control device 10 is a misfire detection device that detects a misfire in the four-stroke engine 20. The control device 10 of this embodiment detects a misfire in the engine 20 based only on the rotation speed of the crankshaft 21.

The control device 10 of this embodiment also has a function as an electronic control device (ECU) that controls operations of the engine 20. The control device 10 is connected to an intake pressure sensor, a fuel injection device, and an ignition plug (not shown).

Figure 2:
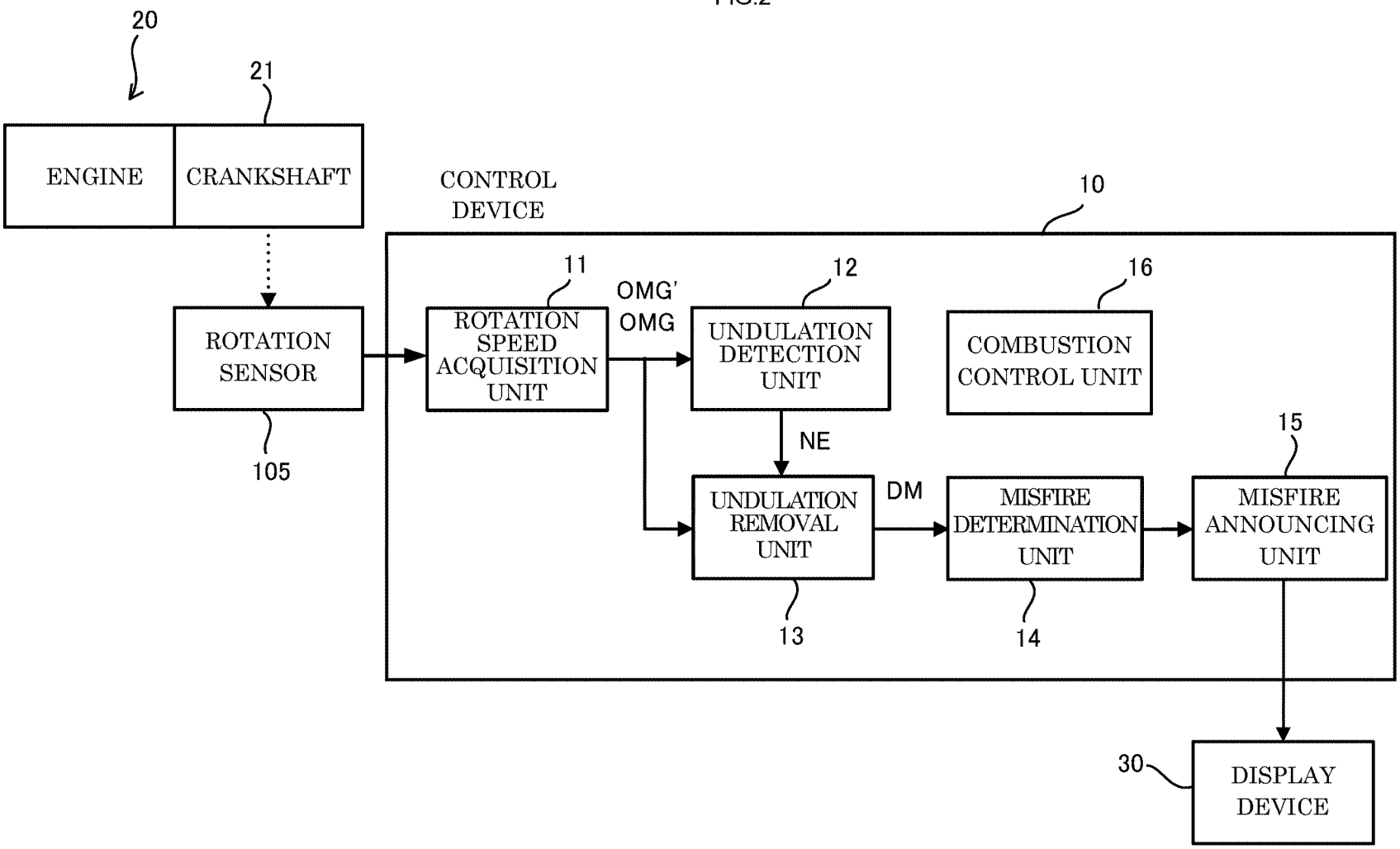
FIG. 2 shows a block diagram showing a configuration of the control device shown in FIG. 1.

FIG. 2 is a block diagram showing a configuration of the control device 10 shown in FIG. 1.

The control device 10 includes a rotation speed acquisition unit 11, an undulation detection unit 12, an undulation removal unit 13, a misfire determination unit 14, a misfire announcing unit 15, and a combustion control unit 16. Each part of the control device 10 is implemented by hardware shown in FIG. 1 being controlled by the CPU 101 (see FIG. 1) which is configured to execute the control program.

The rotation speed acquisition unit 11 obtains the rotation speed of the crankshaft 21 based on an output of the rotation sensor 105. Based on the rotation speed obtained by the rotation speed acquisition unit 11, the undulation detection unit 12 detects a periodic undulation (hereinafter also referred to as "long-period undulation") contained in a rotation fluctuation of the engine 20, the periodic undulation having a longer angular period than that of the crank angle corresponding to four strokes. The undulation removal unit 13 removes the long-period undulation detected by the undulation detection unit 12 from the rotation speed of the engine 20. The misfire determination unit 14 determines the presence or absence of a misfire in the engine 20, based on the rotation fluctuation from which the long-period undulation has been removed. The misfire announcing unit 15 announces a result of determination of the presence or absence of a misfire made by the misfire determination unit 14, by outputting it to the display device 30. The combustion control unit 16 controls a fuel injection unit (not shown) and the ignition plug, to control a combustion operation of the engine 20.

Figure 3:
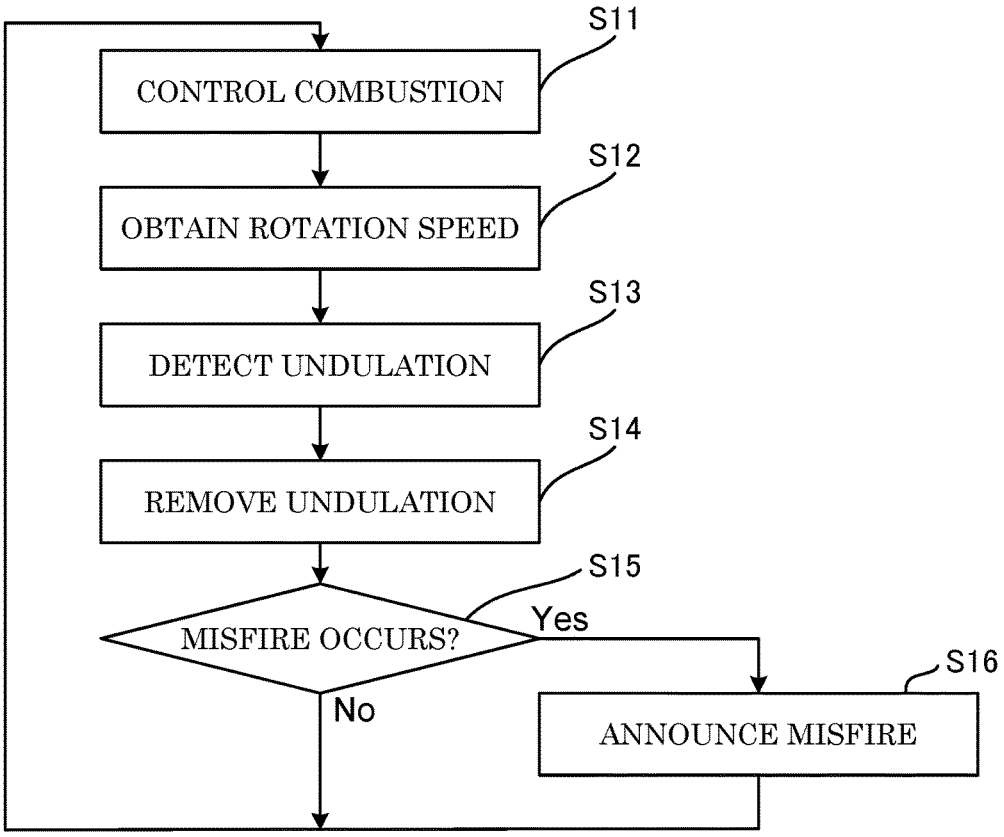
FIG. 3 shows a flowchart of operations of the control device shown in FIG. 2.

FIG. 3 is a flowchart of operations of the control device 10 shown in FIG. 2.

In the control device 10, processing shown in FIG. 3 is repeated. First, the combustion control unit 16 controls the combustion operation of the engine 20 (S11). Then, the rotation speed acquisition unit 11 obtains the rotation speed of the crankshaft 21 of the engine 20 (S12). Then, the undulation detection unit 12 detects a long-period undulation (S13). Then, the undulation removal unit 13 removes the long-period undulation from the rotation speed of the engine 20 (S14). Then, the misfire determination unit 14 determines the presence or absence of a misfire in the engine 20 (S15). Each of the combustion control unit 16, the rotation speed acquisition unit 11, the undulation detection unit 12, and the misfire determination unit 14 executes data processing when its data becomes processable.

If the misfire determination unit 14 determines that there is a misfire (S15:Yes), the misfire announcing unit 15 announces the presence of a misfire (S16). If the misfire determination unit 14 does not determine that there is a misfire (S15:No), the misfire announcing unit 15 does not perform announcement.

The order in which the combustion control unit 16, the rotation speed acquisition unit 11, the undulation detection unit 12, the misfire determination unit 14, and the misfire announcing unit 15 are performed is not limited to the one shown in FIG. 3. Processing in some of the units may be collectively executed as an arithmetic operation based on an expression for acquiring one value. It may not always be necessary that the misfire announcing unit 15 announces the presence of a misfire whenever the misfire determination unit 14 determines the presence of a misfire. For example, it may be acceptable that the misfire determination unit 14 stores a determination result indicating the presence of a misfire each time the misfire determination unit 14 determines the presence of a misfire, and the misfire announcing unit 15 announces the presence of a misfire if the determination result indicating the presence of a misfire, which is stored by the misfire determination unit 14, satisfies a predetermined condition.

Details of the units shown in FIGS. 2 and 3 will now be described.

[Rotation Speed Acquisition Unit]

The rotation speed acquisition unit 11 obtains the rotation speed of the crankshaft 21 based on a signal supplied from the rotation sensor 105 (see FIG. 1). The rotation sensor 105 outputs a signal each time the crankshaft 21 is rotated through the detection angle. The rotation speed acquisition unit 11 measures a time interval of timings at which signals are outputted from the rotation sensor 105, thus measuring a time required for the crankshaft 21 to rotate through the detection angle. Measuring this time serves to determine the rotation speed, which is to be obtained by the rotation speed acquisition unit 11. That is, the rotation speed acquisition unit 11 obtains the rotation speed of the crankshaft 21 by using the crank angle as a reference of an acquisition timing. To be specific, the rotation speed acquisition unit 11 obtains the rotation speed of the crankshaft 21 at every specific crank angle. In this embodiment, the rotation speed obtained by the rotation speed acquisition unit 11 is the rotation speed of the crankshaft 21, and therefore the rotation speed obtained by the rotation speed acquisition unit 11 is the rotation speed of the engine 20.

The rotation speed acquisition unit 11 of this embodiment also obtains, as the rotation speed, a rotation speed corresponding to a zone that covers a plurality of detection angles. For example, the rotation speed acquisition unit 11 obtains the rotation speed in a 180-degree crank angle zone that corresponds to an explosion stroke of each cylinder, and the rotation speed in a 180-degree crank angle zone that corresponds to each stroke interposed between the explosion strokes.

Figure 4:
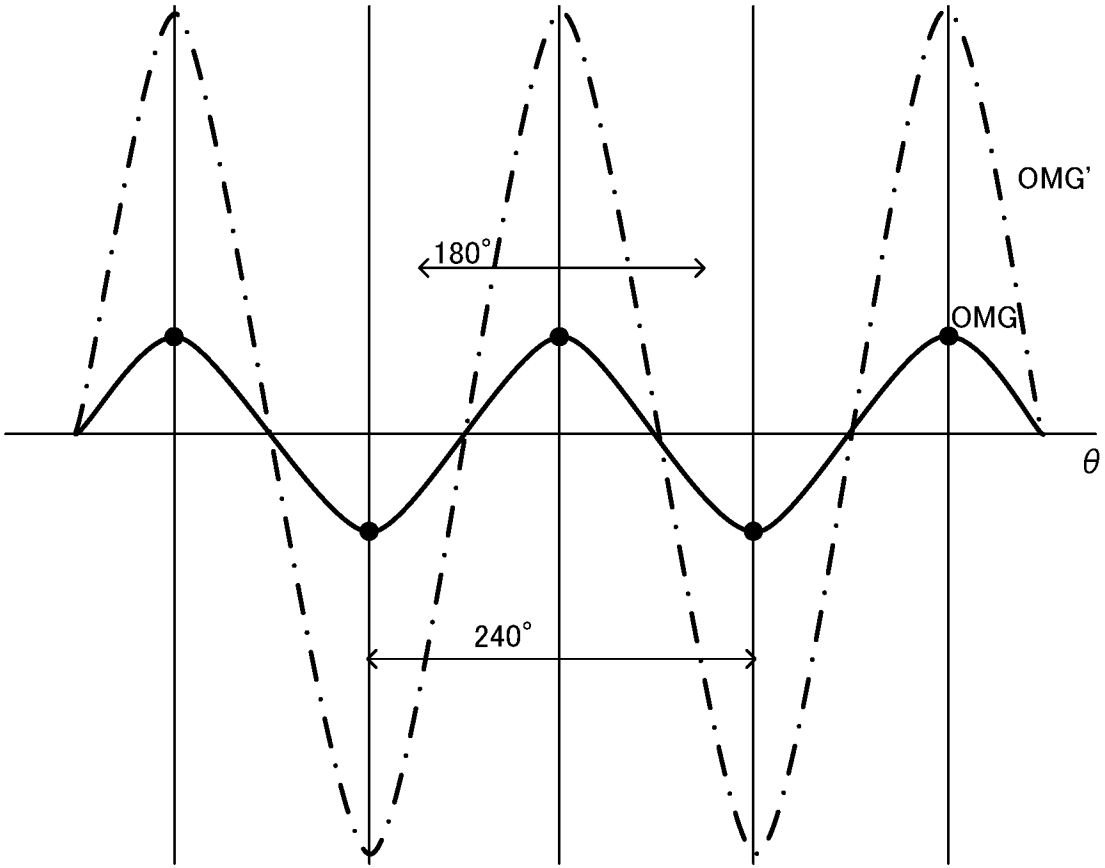
FIG. 4 shows a graph showing a first exemplary rotation speed of a crankshaft rotated by an engine.

FIG. 4 is a graph showing a first exemplary rotation speed of the crankshaft 21 rotated by the engine 20.

In FIG. 4, the horizontal axis represents the rotation angle θ of the crankshaft. The vertical axis represents the rotation speed. In the first example shown in FIG. 4, to facilitate understanding of the relationship of the rotation speed, the rotation speed not containing the long-period undulation is shown. FIG. 4 schematically shows a fluctuation in the rotation speed associated with the combustion operation of the engine 20.

The alternate long and short dash line graph indicates a rotation speed OMG' which is obtained each time a signal is outputted from the rotation sensor 105 in accordance with passing of one detection object portion 25. The alternate long and short dash line graph is a curve obtained by connecting rotation speeds OMG' each obtained in each passing of the detection object portion 25. The rotation speed OMG' is obtained based on a time interval of the signal output. That is, the rotation speed OMG' is the rotation speed at each detection angle. The rotation speed OMG' represents an instantaneous rotation speed.

The engine 20 of this embodiment is a three-cylinder four-stroke engine that causes explosions at even intervals. Thus, the peak of the rotation speed corresponding to the same stroke of each cylinder comes every 720/3 degrees, that is, every 240 crank-angle degrees.

The solid line graph indicates a rotation speed OMG in a zone that covers a plurality of detection angles. The solid line graph indicates a rotation speed OMG in a 180-degree crank angle zone.

The rotation speed acquisition unit 11 calculates the average of rotation speeds OMG' at respective detection angles in the 180-degree crank angle zone, to obtain the value of the rotation speed OMG. Here, the value of the rotation speed OMG at each point can be obtained also by accumulating and summing time intervals of signals received from the rotation sensor 105 in a plurality of zones. The graph of the rotation speed OMG is a curve obtained by connecting points of the values obtained every 120 crank-angle degrees (every half of 240 crank-angle degrees which correspond to the same stroke of each cylinder). Thus, the peak position in the graph of the rotation speed OMG may be misaligned from the peak position of the instantaneous rotation speed. The value at each point in the graph of the rotation speed OMG represents the speed in the 180-degree crank angle zone containing that point. It should be noted that the aforementioned 180 degrees is one example of a zone in which the value of the rotation speed OMG is calculated. In the one example, a value of the rotation speed OMG is obtained by calculating the average of instantaneous rotation speeds in a zone ranging to a point 90 degrees before a rotation angle corresponding to this value and a zone ranging to a point 90 degrees after the rotation angle. The graph of the rotation speed OMG is a curve obtained by connecting the average values thus obtained.

The rotation speed OMG has a smaller amplitude of fluctuation than that of the rotation speed OMG' per detection angle which is an instantaneous rotation speed. The rotation speed OMG, however, represents a rotation fluctuation attributable to combustion of the engine 20. The control device 10 of this embodiment uses the rotation speed OMG in the 180-degree crank angle zone, to detect the presence or absence of a misfire in the engine 20.

The zone in which the value of the rotation speed OMG is calculated may be an angle range other than 180 crank-angle degrees. For example, a crank angle less than 180 degrees, such as 120 crank-angle degrees or 90 crank-angle degrees, may be adoptable for the zone in which the rotation speed OMG is calculated. Alternatively, for example, the detection angle which is 15 crank-angle degrees may be used for the zone in which the rotation speed OMG is calculated. In other words, the rotation speed OMG' may be adopted as the rotation speed OMG. That is, an angle not more than 180 degrees may be adoptable for the zone in which the value of the rotation speed OMG is calculated.

In this embodiment, the rotation speed OMG in the 180-degree crank angle zone is illustrated as the rotation speed of the crankshaft 21 and the rotation speed of the engine 20.

The above-mentioned 180-degree crank angle zone may not necessarily be set so as to completely overlap each stroke, but it may have a variance from each stroke.

The rotation speed OMG in the 180-degree crank angle zone that corresponds to a stroke may also be considered as the rotation speed averaged in the 180-degree crank angle zone, as described above. Here, the rotation speed OMG in the 180-degree crank angle zone is the rotation speed that corresponds to one stroke. The rotation speed OMG in the 180-degree crank angle zone will be simply referred to as the rotation speed, as it is different from the later-described "average rotation speed" which is calculated in a zone corresponding to at least one revolution of the crankshaft 21 in order to detect the long-period undulation.

In the description of this embodiment, the rotation speed OMG, the average rotation speed, and the like, are used as the rotation speed. How these rotation speeds are expressed is not particularly limited. For example, the rotation speed may be expressed in the form of a time required for the crankshaft 21 to rotate through a predetermined angle, or may be expressed in the form of the rotation frequency or the angle per unit time, which is calculated as the inverse of the time through arithmetic operations.

Figure 5:
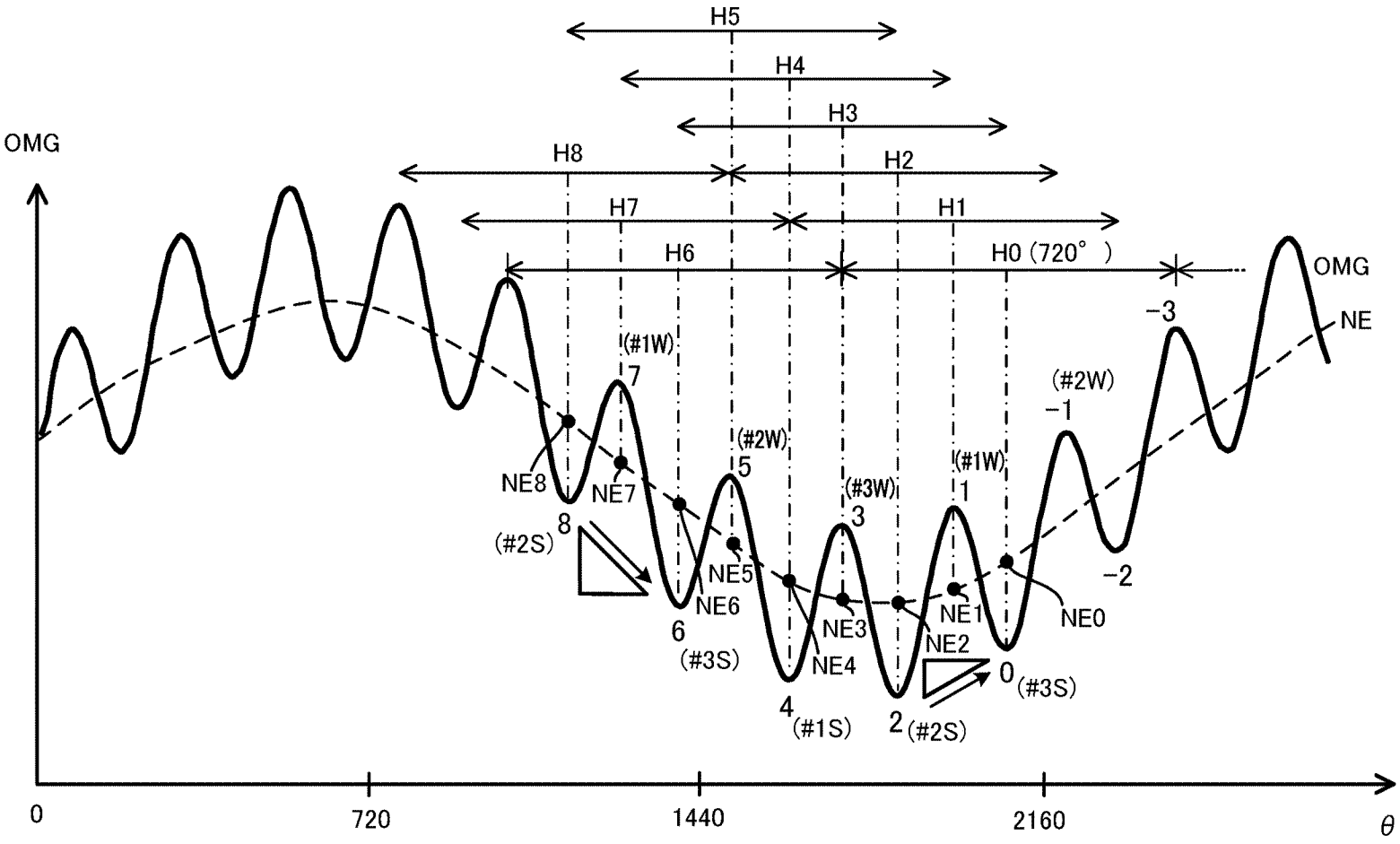
FIG. 5 shows a graph showing a second exemplary rotation speed of the crankshaft rotated by the engine.

FIG. 5 is a graph showing a second exemplary rotation speed of the crankshaft 21 rotated by the engine 20.

In the graph of FIG. 5, the horizontal axis represents the rotation angle θ of the crankshaft 21, and the vertical axis represents the rotation speed. The rotation angle range shown in the graph of FIG. 5 is wider than that shown in the graph of FIG. 4. Similarly to FIG. 4, the solid line graph indicates the rotation speed OMG of the crankshaft 21, which means the rotation speed of the engine 20. The graph schematically shows a fluctuation in the rotation speed OMG. The graph of the rotation speed OMG is a curve obtained by connecting rotation speed values calculated at crank angles corresponding to an explosion stroke and an intake stroke, in the same manner as in FIG. 4.

The engine 20 of this embodiment is a three-cylinder four-stroke engine that causes explosions at even intervals. The peak of the rotation speed corresponding to a compression stroke of each cylinder comes every 240 crank-angle degrees.

In the graph of FIG. 5, a detection target crank angle position at a certain time point is numbered "0", and positions at every 120 crank-angle degrees from the "0" position are numbered sequentially. In the example shown in FIG. 5, an intake stroke (#3S) of a third cylinder among the three cylinders is defined as the "0" position that is the detection target at the certain time point. The "0" position is an intermediate position between the "1" position which corresponds to an explosion stroke (#1W) of a first cylinder and the "−1" position which corresponds to an explosion stroke (#2W) of a second cylinder. The "2", "4", and "6" positions correspond to intake strokes (#2S, #1S, #3S) of the second cylinder, the first cylinder, and the third cylinder, respectively.

The values of the rotation speed OMG at the respective positions "0", "1", "2" . . . are expressed as OMG0, OMG1, OMG2 . . . . This way of expression applies also to other types of rotation speeds which will be described later. The rotation speed of the crankshaft 21 obtained by the rotation speed acquisition unit 11 is the rotation speed of the engine 20. In the description, therefore, the rotation speed OMG of the crankshaft 21 is considered as the rotation speed OMG of the engine 20.

The graph of the rotation speed OMG of the crankshaft 21 shown in FIG. 5 indicates a rotation fluctuation (fluctuation in the rotation speed) of the engine 20.

The rotation fluctuation of the engine 20 contains a rotation fluctuation attributable to the combustion operation of the engine 20. The rotation fluctuation attributable to the combustion operation has repetition periods, the number of which corresponds to the number of cylinders, per 720 crank-angle degrees. The rotation fluctuation in the rotation speed OMG shown in FIG. 5 has three repetition periods per 720 crank-angle degrees. Thus, the rotation fluctuation attributable to the combustion operation of the engine 20 has a period shorter than the crank angle (720 degrees) corresponding to four strokes.

The rotation fluctuation of the engine 20, which is indicated in the graph of the rotation speed OMG, also contains a long-period undulation whose angular period is longer than the crank angle corresponding to four strokes. Thus, the rotation speed of the crankshaft 21 also contains a long-period undulation that is longer than 720 crank-angle degrees. The long-period undulation is a fluctuation attributable to an external factor of the engine. The long-period undulation is, for example, an undulation attributable to a structure of the motorcycle 50 (see FIG. 9) equipped with the engine 20. The long-period undulation is composed of a component of the rotation speed of the four-stroke engine 20, the component fluctuating in accordance with a change of the crank angle during operation of the four-stroke engine 20.

In the graph of FIG. 5, the horizontal axis represents not time but the crank angle. The graph of FIG. 5 indicates a transition of the rotation speed OMG on a crank-angle basis instead of a transition of the rotation speed on a time basis. The long-period undulation periodically varies in the rotation speed OMG which is obtained based on the crank angle serving as a reference of the acquisition timing. Thus, the long-period undulation has a fluctuation period based on the crank angle, that is, an angular period based on the crank angle. When the rotation speed of the engine changes, a time-based period changes, but the angular period which is based on the crank angle does not change. Therefore, the angular period which is based on the crank angle is essentially different from a time-based fluctuation period. The control device 10 is configured to detect a long-period undulation whose angular period is based on the crank angle. While the angular period of the long-period undulation is longer than the crank angle corresponding to four strokes, the amplitude of the long-period undulation is not particularly limited. The waveform of the long-period undulation is not particularly limited, either. Although this embodiment illustrates the long-period undulation having a waveform with its peaks and troughs rounded (see FIGS. 5 and 7), the peaks and troughs may not necessarily be rounded.

[Undulation Detection Unit]

The undulation detection unit 12 shown in FIG. 2 detects a long-period undulation contained in a rotation fluctuation of the engine 20, based on the rotation speed obtained by the rotation speed acquisition unit 11. In this embodiment, the undulation detection unit 12 detects a long-period undulation by repeatedly calculating the average rotation speed of the engine 20 in a (360×m)-degree crank angle zone, where m represents a natural number. In more detail, the undulation detection unit 12 detects a long-period undulation by repeatedly calculating the average rotation speed of the engine 20 in a 720-degree crank angle zone.

More specifically, the undulation detection unit 12 calculates an average rotation speed NE in a 720-degree crank angle zone including a detection target crank angle position. For example, when the detection target is the "6" position shown in FIG. 5, the undulation detection unit 12 calculates an average rotation speed NE6 in a 720-degree crank angle zone H6 including the "6" position. At a time point when the detection target is the "6" position in FIG. 5, the "6" position should be numbered "0", but to avoid confusion involved in such a number change, the position numbers shown in FIG. 5 will be maintained in the description.

After calculating the average rotation speed NE6 based on the "6" position as the detection target, the undulation detection unit 12 sets the "5" position shown in FIG. 5 as the detection target. The undulation detection unit 12 calculates an average rotation speed NE5 in a 720-degree crank angle zone H5 including the "5" position. The undulation detection unit 12 subsequently sets, as the detection target, the "4", "3", "2", "1", and "0" positions in this order. The undulation detection unit 12 calculates average rotation speeds NE4, NE3, NE2, NE1, and NE0 in 720-degree crank angle zones each including each of the positions that are set as the detection target. In this manner, the undulation detection unit 12 repeatedly calculates the average rotation speed ( . . . , NE6, . . . , NE1, . . . ) in the 720-degree crank angle zone (e.g., . . . , H6, . . . , H1, . . . ).

The undulation detection unit 12 of this embodiment repeatedly calculates the average rotation speed in the 720-degree crank angle zone. The engine 20 of this embodiment is a three-cylinder engine. In this embodiment, the average rotation speed NE is calculated each time the crankshaft 21 is rotated through 120 degrees. In the present teaching, a crank angle period in which the average rotation speed is calculated is not particularly limited. Examples of the crank angle period include 360 crank-angle degrees, 540 crank-angle degrees, and 900 crank-angle degrees. In this embodiment, the undulation detection unit 12 calculates the average rotation speed NE by using the rotation speed OMG' at every detection angle which is obtained by the rotation speed acquisition unit 11. For example, the undulation detection unit 12 sets the "6" position corresponding to the intake stroke (#3S) of the third cylinder as the detection target, and calculates the average rotation speed NE6 in the 720-degree crank angle zone H6 including the "6" position. Then, the undulation detection unit 12 sets the "5" position corresponding to the explosion stroke (#2W) of the second cylinder as the detection target, and calculates the average rotation speed NE5 in the 720-degree crank angle zone H5 including the "5" position. Then, the undulation detection unit 12 sets the "4" position corresponding to the intake stroke (#1S) of the first cylinder as the detection target, and calculates the average rotation speed NE4 in the 720-degree crank angle zone H4 including the "4" position. Then, the undulation detection unit 12 sets the "3" position corresponding to the explosion stroke (#3W) of the third cylinder as the detection target, and calculates the average rotation speed NE3 in the 720-degree crank angle zone H3 including the "3" position. Then, the undulation detection unit 12 sets the "2" position corresponding to the intake stroke (#2S) of the second cylinder as the detection target, and calculates the average rotation speed NE2 in the 720-degree crank angle zone H2 including the "2" position. This way, the undulation detection unit 12 sequentially calculates the average rotation speed NE. Then, the undulation detection unit 12 again sets the "1" position corresponding to the explosion stroke (#1W) of the first cylinder as the detection target, and calculates the average rotation speed NE1. Then, the undulation detection unit 12 again sets the "0" position corresponding to the intake stroke (#3S) of the third cylinder as the detection target.

The undulation detection unit 12 calculates the average rotation speed NE6, NE5, NE4, NE3, NE2, NE1, NE0, . . . of the engine 20 in the 720-degree crank angle zone H6, H5, H4, H3, H2, H1, H0, . . . with respect to each cylinder and each zone H6, H5, H4, H3, H2, H1, H0, . . . . This way, the undulation detection unit 12 detects a long-period undulation NE which is indicated by the broken line in the graph of FIG. 5. Each of the average rotation speeds NE6, NE5, NE4, NE3, NE2, NE1, NE0, . . . serves as a component of the long-period undulation NE. To be exact, each of the average rotation speeds NE6, NE5, NE4, NE3, NE2, NE1, NE0, . . . serves as a time-axis component of the long-period undulation NE.

In detecting each of the components NE6, NE5, NE4, NE3, NE2, NE1, NE0, . . . of the long-period undulation NE, the undulation detection unit 12 detects a component of the long-period undulation at a detection target position, based on a rotation speed in a range from a crank angle position before the detection target crank angle position to a crank angle position after the detection target crank angle position, the rotation speed being obtained by the rotation speed acquisition unit 11. That is, the undulation detection unit 12 obtains the average rotation speed in a crank angle zone including the detection target crank angle position, to detect a component of the long-period undulation NE at the detection target position. The crank angle zone in which the average rotation speed is obtained includes a zone before the detection target position and a zone after the detection target position. For example, the length of the zone before the detection target position is equal to the length of the zone after the detection target position. The relationship between the lengths of these zones is not limited to the above. For example, these zones may have different lengths. For example, in a case of the detection target being the "0" position, the undulation detection unit 12 sets, as the zone H0, a 720-degree crank angle zone including 360 crank-angle degrees before the "0" position and 360 crank-angle degrees after the "0" position. Based on the rotation speed obtained in the 720-degree crank angle zone H0, the undulation detection unit 12 detects the component NE0 of the long-period undulation at the "0" position as the detection target.

To calculate the average rotation speed at the "0" position as the detection target, information of the rotation speed which is obtained 360 crank-angle degrees after the "0" position is required as input information for the calculation. Therefore, to calculate the average rotation speed NE0 at the "0" position as the detection target, it is necessary to wait for further rotation of the crankshaft 21 by 360 crank-angle degrees from the "0" position. In other words, a detection target position for the average rotation speed calculated is a position at least 360 crank-angle degrees before the position where the crankshaft 21 is located at a time point of the calculation.

In the graph of FIG. 5, the broken line schematically indicates values obtained by repeated calculation of the average rotation speed of the engine 20 in the 720-degree crank angle zone.

The undulation detection unit 12 of this embodiment detects an undulation by calculating the average rotation speed in a limited zone. An undulation detected by the undulation detection unit 12 is, in a strict sense, sometimes not completely coincident with an actual long-period undulation contained in the rotation speed OMG. The calculated average rotation speed NE, however, can be used for effective detection and removal of a long-period undulation from the rotation speed outputted from the rotation speed acquisition unit 11. An undulation of the average rotation speed NE detected by the undulation detection unit 12 can be considered as substantially equivalent to the long-period undulation NE. Therefore, a description will be given on the assumption that the long-period undulation NE is the undulation of the average rotation speed NE detected by the undulation detection unit 12.

The undulation detection unit 12 of this embodiment calculates the average rotation speed NE of the engine 20 in a (360×m)-degree crank angle zone, where m represents a natural number. That is, the average rotation speed is calculated in a period over which the rotating crankshaft 21 returns to the original position. In this configuration, the average rotation speed NE is calculated based on a time taken for one of the plurality of detection object portions 25 of the crankshaft 21 to pass the rotation sensor 105 a plurality of times. This can make the detection less influenced by, for example, a tolerance of the position where each detection object portion 25 is provided. In other words, an influence of, for example, a tolerance of the rotation position of the crankshaft 21 can be reduced. Accordingly, the long-period undulation can be detected with good accuracy.

The undulation detection unit 12 of this embodiment calculates the average rotation speed NE of the engine 20 in the 720-degree crank angle zone. The 720 crank-angle degrees correspond to four strokes of the engine 20. The 720 crank-angle degrees correspond to one cycle of the engine 20. Therefore, the average rotation speed NE in the 720-degree crank angle zone is the average rotation speed in a zone interposed between the same type of strokes that occur consecutively in one cylinder (for example, a zone from an intake stroke to the next intake stroke). This can make a detection result less influenced by a difference in strokes included in each zone for which the average rotation speed NE is calculated. In addition, calculating the average rotation speed NE in the 720-degree crank angle zone enables an undulation having a period longer than 720 crank-angle degrees to be detected. That is, a long-period undulation is detectable over a wide range. Accordingly, the long-period undulation can be detected with further increased accuracy.

The undulation detection unit 12 detects a component of the long-period undulation at a detection target crank angle position, based on a rotation speed in a range from a crank angle position before the detection target crank angle position to a crank angle position after the detection target crank angle position, the rotation speed being obtained by the rotation speed acquisition unit 11. As a result, the long-period undulation NE detected based on a calculation from the rotation speed by the undulation detection unit 12 is less phase-shifted relative to a long-period undulation contained in the actual rotation speed OMG, when compared on the basis of the same crank angle position. Accordingly, a long-period undulation can be removed with further increased accuracy if arithmetic operations are further performed on the calculated long-period undulation and the rotation speed of the engine 20.

The rotation speed acquisition unit 11 of this embodiment obtains the rotation speed of the crankshaft 21 (rotating element), not based on time but based on the crank angle serving as a reference of the acquisition timing. Thus, the rotation speed acquisition unit 11 obtains the rotation speed of the crankshaft 21 (rotating element) not every predetermined time but every predetermined crank angle. The undulation detection unit 12 detects a long-period undulation based on the rotation speed that is obtained by the rotation speed acquisition unit 11 with use of the crank angle as a reference of the acquisition timing.

The fluctuation in the rotation speed of the engine includes a fluctuation attributable to an external factor of the engine. Examples of the fluctuation attributable to the external factor of the engine include a fluctuation attributable to the structure of an apparatus, such as a motorcycle, to which the engine is mounted. When viewed on the time axis, a period of the fluctuation attributable to the external factor of the engine may sometimes change depending on the rotation speed of the engine. It is therefore not easy to detect a fluctuation in the rotation speed attributable to an external factor if the rotation speed is obtained based on a predetermined time as a reference.

In this embodiment, a long-period undulation attributable to an external factor of the engine is detected based on the rotation speed that is obtained based on the crank angle. This can make a fluctuation in the rotation speed of the engine less influential to detection. Accordingly, a long-period undulation can be detected with high accuracy.

[Undulation Removal Unit]

The undulation removal unit 13 removes the long-period undulation detected by the undulation detection unit 12 from the rotation speed of the engine 20 that is obtained based on the rotation speed of the crankshaft 21. The undulation removal unit 13 calculates a difference between the rotation speed OMG of the engine 20 that is obtained based on the rotation speed of the crankshaft 21 and the long-period undulation NE that is detected by the undulation detection unit 12. More specifically, regarding the rotation speed OMG of the crankshaft 21 and the long-period undulation NE shown in FIG. 5, the undulation removal unit 13 calculates a difference obtained by subtracting the long-period undulation NEn from the rotation speed OMGn (where n represents an integer). In this manner, a periodic long-period undulation detected by the undulation detection unit 12 is removed from the rotation speed OMG of the engine 20. The undulation detection unit 12 may also use the rotation speed OMG' shown in FIG. 4 instead of the rotation speed OMG shown in FIG. 5, as the rotation speed OMG of the engine 20.

Figure 6:
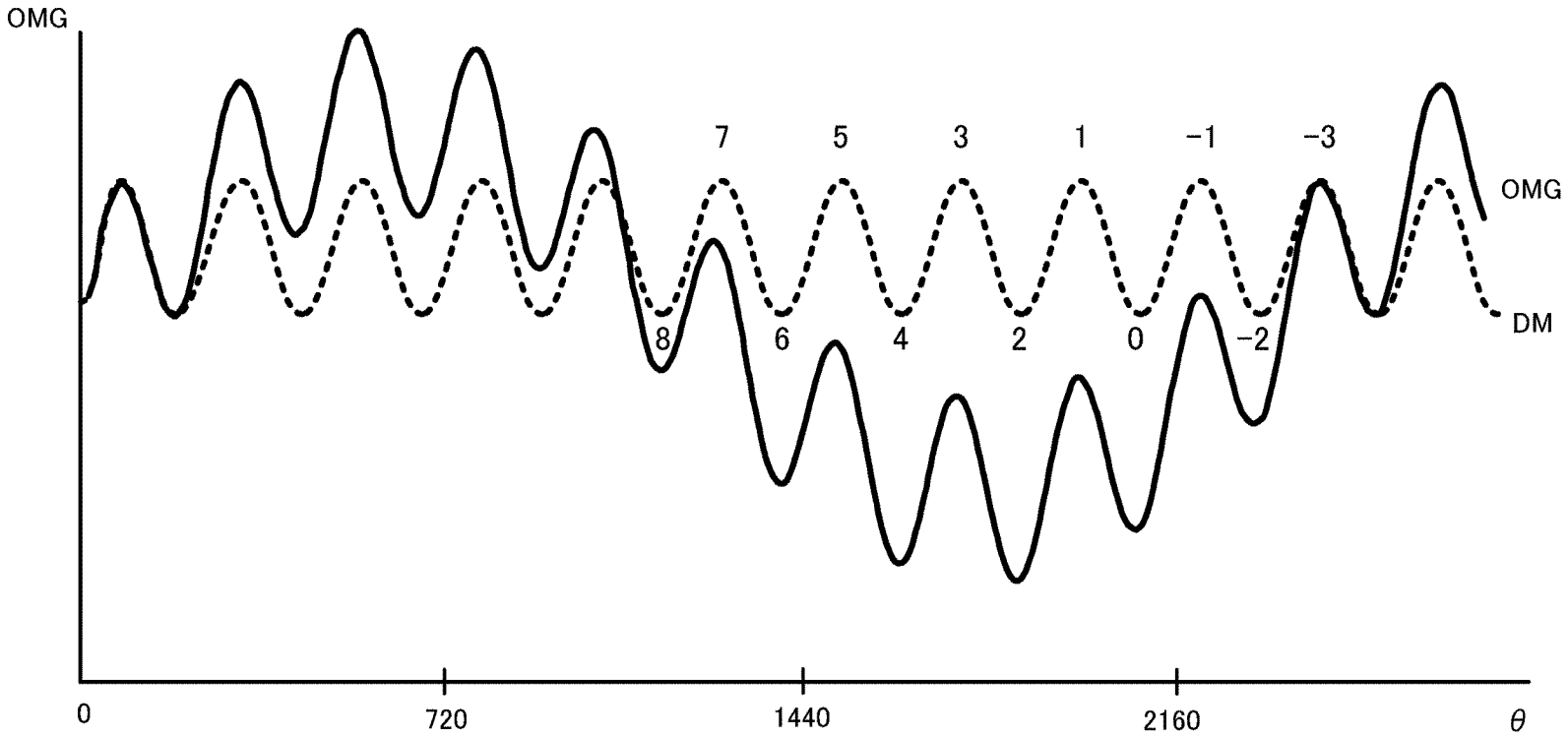
FIG. 6 shows a graph showing an exemplary rotation speed after an undulation removal unit removes a long-period undulation from the rotation speed of the crankshaft.

FIG. 6 is a graph showing an exemplary rotation speed after the undulation removal unit 13 removes the long-period undulation NE from the rotation speed OMG of the crankshaft 21.

In the graph of FIG. 6, the broken line schematically indicates an example of a rotation speed DM obtained by removal of the long-period undulation NE (see FIG. 5) from the rotation speed OMG of the crankshaft 21.

The rotation speed DM, which is obtained by removal of the long-period undulation by the undulation removal unit 13, represents a rotation fluctuation attributable mainly to combustion of the engine 20. In the rotation speed DM, an influence of the long-period undulation is suppressed.

[Misfire Determination Unit]

The misfire determination unit 14 shown in FIG. 2 determines the presence or absence of a misfire in the engine 20 based on a rotation fluctuation attributable to combustion of the engine 20. The rotation fluctuation attributable to combustion of the engine 20 is a rotation fluctuation in the rotation speed obtained by removal of the long-period undulation detected by the undulation detection unit 12 from the rotation speed OMG of the engine 20. The rotation fluctuation attributable to combustion of the engine 20 is a fluctuation in the rotation speed DM shown in the graph of FIG. 6, for example.

The misfire determination unit 14 calculates the amount of fluctuation between cylinders in which the same stroke successively occurs, in the rotation speed DM obtained by removal of the long-period undulation NE detected by the undulation detection unit 12 from the rotation speed OMG of the engine 20. The misfire determination unit 14 determines a misfire in the four-stroke engine by calculating the amount of fluctuation.

The misfire determination unit 14 calculates a difference between rotation speeds in the cylinders in which the same stroke successively occurs. The misfire determination unit 14 uses, as the rotation speed, the rotation speed DM (see FIG. 6) obtained by removal of the long-period undulation NE detected by the undulation detection unit 12 from the rotation speed OMG of the engine 20. That is, the misfire determination unit 14 obtains the amount of fluctuation in the rotation speed DM which is obtained by removal of the long-period undulation NE. The difference calculated in this manner is herein defined as a first fluctuation amount. For example, when the "0" position shown in FIG. 6 is set as a detection target, the "0" and "2" positions are crank angle positions corresponding to cylinders in which the same stroke successively occurs. For example, the "2" position corresponds to an intake stroke of the second cylinder (#2S in FIG. 5). The "0" position corresponds to an intake stroke of the third cylinder (#3S in FIG. 5). Thus, the intake stroke of the second cylinder and the intake stroke of the third cylinder occur successively in the "2" position and "0" position. The first fluctuation amount is a difference between a rotation speed DM2 and a rotation speed DM0. The rotation speed DM2 is the rotation speed obtained by removal of the long-period undulation NE2 (see FIG. 5) detected by the undulation detection unit 12 from the rotation speed OMG of the engine 20 at the "2" position shown in FIG. 6. The rotation speed DM0 is the rotation speed obtained by removal of the long-period undulation NE0 detected by the undulation detection unit 12 from the rotation speed OMG of the engine 20 at the "0" position.

The misfire determination unit 14 also calculates a difference between rotation speeds in cylinders in which the same stroke successively occurs at positions 720 crank-angle degrees before the positions of the crankshaft 21 where the first fluctuation amount is calculated. This difference is defined as a second fluctuation amount. Positions of the crankshaft corresponding to cylinders in which the same stroke successively occurs at the positions 720 crank-angle degrees before are the "6" and "8" positions. The second fluctuation amount is a difference between a rotation speed DM8 and a rotation speed DM6. The rotation speed DM6 is the rotation speed obtained by removal of the long-period undulation NE6 detected by the undulation detection unit 12 from the rotation speed OMG of the engine 20 at the "6" position. The rotation speed DM8 is the rotation speed obtained by removal of the long-period undulation NE8 detected by the undulation detection unit 12 from the rotation speed OMG of the engine 20 at the "8" position.

The misfire determination unit 14 also calculates, as a fluctuation index AOMG, a difference between the first fluctuation amount and the second fluctuation amount mentioned above. If the fluctuation index ΔOMG is more than a misfire determination value CK, the misfire determination unit 14 determines the presence of a misfire. If the fluctuation index ΔOMG is less than the misfire determination value CK, the misfire determination unit 14 determines the absence of a misfire.

[Misfire Announcing Unit]

The misfire announcing unit 15 announces the presence or absence of a misfire as determined by the misfire determination unit 14. If the misfire determination unit 14 determines the presence of a misfire, the misfire announcing unit 15 directs the display device 30 (see FIG. 1) to display the presence of a misfire.

The above-described processing performed by the undulation detection unit 12, the undulation removal unit 13, and the misfire determination unit 14 will now be collectively described with reference to FIG. 5.

The misfire determination unit 14 determines the presence or absence of a misfire based on a change of the amount of fluctuation in the rotation speed obtained by removal of a periodic undulation after passing a predetermined angle zone.

To be more specific, the misfire determination unit 14 determines the presence or absence of a misfire based on a change between the first fluctuation amount and the second fluctuation amount. The first fluctuation amount is the amount of fluctuation between, in the rotation speed obtained by removal of a periodic undulation, rotation speeds in cylinders in which the same stroke successively occurs. The second fluctuation amount is the amount of fluctuation between rotation speeds at positions of a predetermined crank angle zone after the positions where the amount of fluctuation between the rotation speeds in the cylinders in which the same stroke successively occurs is calculated. The predetermined crank angle zone has, in this embodiment, 720 crank-angle degrees.

The misfire determination unit 14 calculates, as the fluctuation index ΔOMG, a difference between the first fluctuation amount and the second fluctuation amount.

The first fluctuation amount is the amount of fluctuation between rotation speeds in cylinders in which the same stroke successively occurs. The first fluctuation amount is a difference between rotation speeds in the intake strokes (#3S and #2S in FIG. 5) of the third cylinder and the second cylinder in which the intake stroke successively occurs. Referring to the example shown in FIG. 6, when the "0" position is set as a detection target, the first fluctuation amount is a difference between a rotation speed at the "0" position and a rotation speed at the "2" position. The rotation speed at the "0" position is the rotation speed DM0 (see FIG. 6) which is obtained by removal of the long-period undulation NE0 from the rotation speed OMG0. The long-period undulation is the average rotation speed in the (360×m)-degree crank angle zone. In this embodiment, the long-period undulation is the average rotation speed in the 720-degree crank angle zone. In detail, the long-period undulation NE0 at the "0" position is the average rotation speed of rotation speeds OMG in the 720-degree crank angle zone H0 including the "0" position. The rotation speed at the "2" position is the rotation speed DM2 (see FIG. 6) obtained by removal of the long-period undulation NE2 from the rotation speed OMG2 of the crankshaft 21. The long-period undulation NE2 at the "2" position is the average rotation speed of rotation speeds OMG in the 720-degree crank angle zone 112 including the "2" position. In more detail, the long-period undulation NE is the average rotation speed of rotation speeds OMG' at the respective detection angles shown in FIG. 4.

The first fluctuation amount is the amount of fluctuation in the rotation speed after passing a predetermined crank angle zone relative to the second fluctuation amount. More specifically, the first fluctuation amount is the amount of fluctuation in the rotation speed after passing the 720 crank-angle degrees zone relative to the second fluctuation amount. The second fluctuation amount is the amount of fluctuation in the rotation speed before passing the 720 crank-angle degrees zone relative to the first fluctuation amount. In the example shown in FIG. 6, the second fluctuation amount is a difference between the rotation speed at the "6" position and the rotation speed at the "8" position. The rotation speed at the "6" position is the rotation speed DM6 (see FIG. 6) obtained by removal of the long-period undulation NE6 from the rotation speed OMG6 of the crankshaft 21. The long-period undulation NE6 at the "6" position is the average rotation speed of rotation speeds OMG in the 720-degree crank angle zone 116 including the "6" position. The rotation speed at the "8" position is the rotation speed DM8 (see FIG. 6) obtained by removal of the long-period undulation NE8 from the rotation speed OMG8 of the crankshaft 21. The long-period undulation NE8 at the "8" position is the average rotation speed of rotation speeds OMG in the 720-degree crank angle zone H8 including the "8" position.

Each of the above-described fluctuation amounts, such as the first fluctuation amount and the second fluctuation amount, is the amount of fluctuation between rotation speeds in cylinders in which the same stroke successively occurs. In a case where a misfire occurs in either of the successive cylinders, the amount of fluctuation increases. The amount of fluctuation, however, increases also in a case where, for example, engine rotation is accelerated or decelerated in accordance with a control.

In this embodiment, the misfire determination unit 14 calculates a difference between the first fluctuation amount and the second fluctuation amount, to make a determination about a change of the amount of fluctuation in the rotation speed after passing the 720 crank-angle degrees zone. This can suppress an influence of acceleration or deceleration of the engine rotation in accordance with a control. In addition, a change of the amount of fluctuation in the rotation speed after passing the 720 crank-angle degrees zone is determined, which means that the determination is made based on a change of the rotation speed in the same stroke. Accordingly, there is a reduced influence of a difference in strokes at determinated target positions.

The accuracy of an appropriate determination of a misfire deteriorates in a case where the misfire determination unit 14 calculates a difference between the fluctuation amounts based on the rotation speed OMG containing the long-period undulation.

For example, in the rotation speed OMG shown in FIG. 5, the first fluctuation amount between the "0" and "2" positions and the second fluctuation amount between the "6" and "8" positions is different from each other due to the long-period undulation. In FIG. 5, the triangles represent the first fluctuation amount and the second fluctuation amount. Because of the difference between the first fluctuation amount and the second fluctuation amount, there is a risk of erroneous detection of a misfire even though a misfire is not actually occurring.

The control device 10 of this embodiment is able to detect a long-period undulation contained in the rotation speed OMG of the engine 20 by means of the rotation speed acquisition unit 11 and the undulation detection unit 12. The undulation removal unit 13, therefore, is able to obtain a rotation fluctuation attributable to combustion of the engine 20 by removing the long-period undulation from the rotation speed of the engine 20. As a result, the misfire determination unit 14 is able to detect the presence or absence of a misfire in the engine while receiving a less influence from the long-period undulation. For example, a situation can be suppressed where, in a determination of a misfire in the engine, the presence of a misfire is erroneously detected due to an influence of the long-period undulation.

Accordingly, the control device 10 is applicable to a motorcycle which is an apparatus having a long-period undulation contained in the rotation speed of the engine 20.

At a time point when the rotation speed OMG at a detection target crank angle position is obtained, the misfire determination unit 14 does not perform misfire detection at the detection target crank angle position. The undulation detection unit 12 detects a component of a long-period undulation at the detection target crank angle position, based on a rotation speed OMG in a range from a crank angle position before the detection target crank angle position to a crank angle position after the detection target crank angle position, the rotation speed OMG being obtained by the rotation speed acquisition unit 11. The detected component of the long-period undulation is removed from a rotation fluctuation by the undulation removal unit 13. The misfire determination unit 14 performs misfire detection based on the rotation speed DM obtained as a result of removal of the component of the long-period undulation from the rotation speed OMG. This point will now be described based on an exemplary case where the detection target crank angle position is the "0" position in FIG. 5.

In a period from when the rotation speed OMG0 at the "0" position is obtained to when misfire detection for the "0" position is performed, the rotation speed acquisition unit 11 obtains the rotation speed OMG in the zone "H0" of a predetermined crank angle (720 crank-angle degrees) including the "0" position. To be exact, the rotation speed acquisition unit 11 stores, in the memory 102 (see FIG. 1), data of the rotation speed in the zone "H0" from the crank angle position "3" which is before the crank angle position "0" that is the detection target to the crank angle position "−3" which is after the crank angle position "0" that is the detection target. Then, the undulation detection unit 12 calculates the average rotation speed NE0 of rotation speeds in the zone "H0" stored in the memory 102, to detect a component of a long-period undulation at the crank angle position "0" that is the detection target. The undulation removal unit 13 removes the component of the long-period undulation from the rotation speed OMG at the "0" position. In this manner, the rotation speed DM0 at the "0" position attributable to combustion of the engine 20 is obtained. The misfire determination unit 14 performs misfire determination for the "0" position based on the rotation speed DM0 at the "0" position attributable to combustion of the engine 20.

Generally in the fields of an engine combustion control as typified by an ignition timing control for example, a control with suppression of a delay is strictly required. Therefore, it is conventionally believed that, for example, an engine misfire as well as the engine combustion control needs to be detected at an earliest possible stage. The inventors of the present teaching changed the way of thinking and overturned such a conventional wisdom, to arrive at the following idea.

When detecting of an engine misfire or the like, an early-stage detection may sometimes not be strictly required unlike the ignition timing control for example. In the engine, not only misfire detection but also other detection, diagnosis, monitoring, control, and the like, may sometimes not strictly need to be performed at an early stage. In such a case, it is not always necessary to, at a time point when the rotation speed OMG corresponding to a detection target crank angle position is obtained, perform misfire detection or the like for the angle position. Even after the rotation speed OMG corresponding to the angle position is obtained, data can be obtained in a zone for which the average rotation speed is calculated. Data about the rotation frequency in a zone, which includes data obtained after the rotation speed OMG corresponding to the angle position is obtained and the data obtained before the rotation speed OMG is obtained, can be used for misfire detection, etc. for the angle position. This can increase the accuracy of misfire detection, etc.

This embodiment is based on the above-described idea. In this embodiment, the misfire determination unit 14 does not perform misfire determination for the "0" position at a time point when the rotation speed OMG0 at the "0" position is obtained. Thereafter, at a time point when the rotation speed DM0 at the "0" position attributable to combustion of the engine 20 is obtained as a result of removal of the component NE0 of the long-period undulation, the misfire determination unit 14 performs misfire determination for the "0" position. This can make the long-period undulation less influential to the misfire detection. This is why the control device 10 is suitable as an engine diagnosis device (misfire detection device). The control device 10 has a high degree of freedom in the choice of an apparatus to which it is applicable, and is suitable for application to a motorcycle, for example.

[Second Embodiment]

Next, a second embodiment of the present teaching will be described. In the following description of the second embodiment, differences from the above-described first embodiment will mainly be described.

Figure 7:
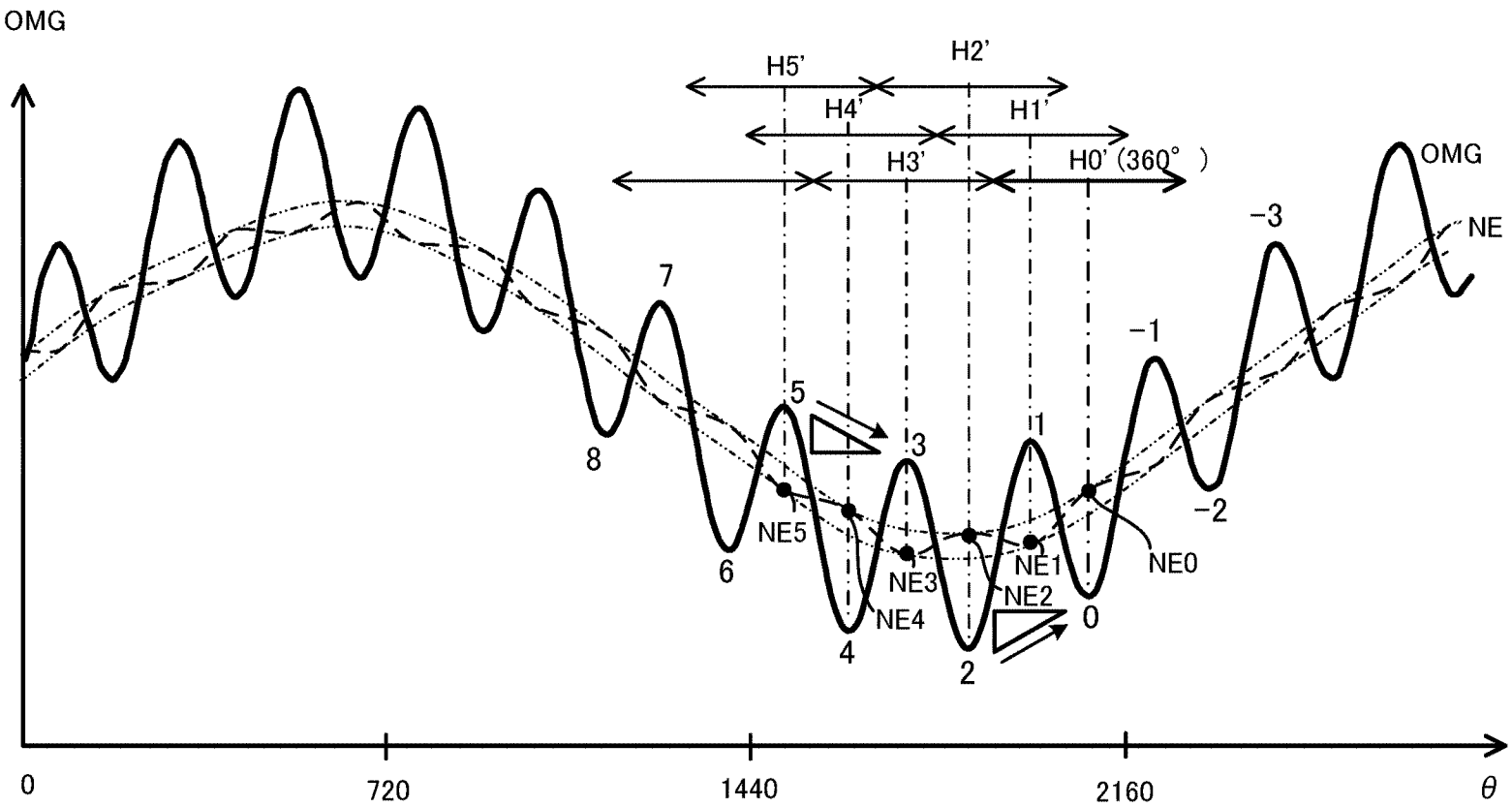
FIG. 7 shows a graph for an explanation of processing performed by a control device according to a second embodiment of the present teaching.

FIG. 7 is a graph for explaining a of processing performed by the control device 10 according to the second embodiment of the present teaching.

In FIG. 7, the rotation speed OMG of the engine 20, and the numbering of "0", "1", "2", . . . are identical to those of the first embodiment shown in FIG. 5.

The undulation detection unit 12 of the control device 10 detects a long-period undulation by repeatedly calculating the average rotation speed of the engine 20 in a (360×m)-degree crank angle zone, where m represents a natural number. The undulation detection unit 12 of the control device 10 of this embodiment calculates an average rotation speed NE in a 360-degree crank angle zone including a detection target crank angle position. For example, when the detection target is the "3" position shown in FIG. 7, the undulation detection unit 12 calculates an average rotation speed NE3 in a 360-degree crank angle zone H3' including the "3" position.

After calculating the average rotation speed NE3 based on the "3" position as the detection target, the undulation detection unit 12 sets the "0" position shown in FIG. 7 as the detection target. The undulation detection unit 12 calculates an average rotation speed NE0 in a 360-degree crank angle zone H0' including the "0" position. In this manner, the undulation detection unit 12 calculates the average rotation speed NE in the 360-degree crank angle zone.

The 360-degree crank angle zone is shorter than other (360×m)-degree crank angle zones. This makes it likely that a long-period undulation having a longer period is detected.

The undulation detection unit 12 calculates the average rotation speed NE in the 360-degree crank angle zone with respect to each cylinder of the engine 20. In this embodiment, the average rotation speed NE is calculated each time the crankshaft 21 is rotated through 120 degrees. For example, the undulation detection unit 12 sets the "3" position shown in FIG. 7 as the detection target, and calculates an average rotation speed NE3 in a 360-degree crank angle zone H3' including the "3" position. Then, the undulation detection unit 12 sets the "2" position as the detection target, and calculates an average rotation speed NE2 in a 360-degree crank angle zone H2' including the "2" position. Then, the undulation detection unit 12 sets the "1" position as the detection target, and calculates an average rotation speed NE1 in a 360-degree crank angle zone H1' including the "1" position.

The undulation detection unit 12 calculates the average rotation speed NE3, NE2, NE1, NE0, . . . of the engine 20 in each of 360-degree crank angle zones H3', H2', H1', H0', . . . with respect to each cylinder and each zone H3', H2', H1', H0', . . . . This way, the undulation detection unit 12 detects a long-period undulation NE as indicated by the broken line in the graph of FIG. 7. Each of the average rotation speeds NE3, NE2, NE1, NE0, . . . serves as a component of the period undulation NE.

In detecting each of the components NE3, NE2, NE1, NE0, . . . of the long-period undulation NE, the undulation detection unit 12 detects a component of the long-period undulation at a detection target crank angle position, based on a rotation speed in a range from a crank angle position before the detection target crank angle position to a crank angle position after the detection target crank angle position, the rotation speed being obtained by the rotation speed acquisition unit 11. In this embodiment, for example, in a case of the detection target being the "0" position, the undulation detection unit 12 sets, as the zone H0', a 360-degree crank-angle zone including 180 crank-angle degrees before the "0" position and 180 crank-angle degrees after the "0" position.

In this embodiment, the undulation detection unit 12 detects the long-period undulation by calculating the average rotation speed of the engine 20 in the 360-degree crank angle zone H3', H2', H1', H0', . . . . Since the engine 20 of this embodiment is a three-cylinder engine, the type of stroke included in each 360-degree crank angle zone differs among the respective zones. Accordingly, the average rotation speed NE of the engine 20 in each of the 360-degree crank angle zones H3', H2', H1', H0', . . . contains a fluctuation specific to each zone. In this case as well, the average rotation speed of the engine 20 in each of the 360-degree crank angle zones H3', H2', H1', H0', . . . is calculated, so that a fluctuation in the rotation speed within a range of 360 crank-angle degrees is averaged. Accordingly, the long-period undulation can be detected with good accuracy.

In this embodiment, the zone in which the average rotation speed NE is calculated has 360 crank-angle degrees and is shorter than the zone of the first embodiment. Therefore, in the detected long-period undulation, an undulation having a shorter period, e.g., a period approximate to the angular period of the crank angle corresponding to four strokes, has its detected amplitude less damped. Accordingly, the long-period undulation can be detected with increased accuracy.

In this embodiment, if the average rotation speed NE calculated in each zone is referred to in a period of 240 crank-angle degrees which corresponds to the same stroke, more accurate detection is enabled. For example, as indicated by the double alternate long and two short dashes lines in FIG. 7, referring to a group of calculation results (NE4, NE2, NE0, . . . ) for the zones H4', H2', H0', . . . and a group of calculation results (NE5, NE3, NE1, . . . ) for the zones H5', H3', H1', . . . enables more accurate detection of the long-period undulation.

In this embodiment, the misfire determination unit 14 calculates a difference between rotation speeds in cylinders in which the same stroke successively occurs, the rotation speeds being obtained by removal of the long-period undulation NE detected by the undulation detection unit 12 from the rotation speed OMG of the engine 20. The difference calculated is defined as a first fluctuation amount. The calculation of the first fluctuation amount in this embodiment is the same as that of the first embodiment. To be specific, the first fluctuation amount is a difference between a rotation speed at the "2" position and a rotation speed at the "0" position, these rotation speeds being in the rotation speed obtained by removal of the long-period undulation NE.

In this embodiment, the misfire determination unit 14 calculates a difference between rotation speeds in cylinders in which the same stroke successively occurs at positions 360 crank-angle degrees before the positions of the crankshaft 21 where the first fluctuation amount is calculated. This difference is defined as a second fluctuation amount. Positions of the crankshaft corresponding to cylinders in which the same stroke successively occurs at the positions 360 crank-angle degrees before are the "3" and "5" positions. The second fluctuation amount is a difference between a rotation speeds at the "5" position and a rotation speed at the "3" positions, these rotation speed being in the rotation speed obtained by removal of the long-period undulation NE.

The misfire determination unit 14 calculates, as a fluctuation index ΔOMG2, a difference between the first fluctuation amount and the second fluctuation amount. If the fluctuation index ΔOMG2 is more than a misfire determination value CK, the misfire determination unit 14 determines the presence of a misfire. If the fluctuation index ΔOMG2 is less than the misfire determination value CK, the misfire determination unit 14 determines the absence of a misfire.

The processing performed by the undulation detection unit 12, the undulation removal unit 13, and the misfire determination unit 14 of this embodiment will now be collectively described with reference to FIG. 7.

The misfire determination unit 14 calculates, as the fluctuation index ΔOMG2, a difference between the first fluctuation amount and the second fluctuation amount.

The first fluctuation amount is a difference between the rotation speed at the "0" position and the rotation speed at the "2" position. The rotation speed at the "0" position is a rotation speed obtained by removal of a long-period undulation NE0 from a rotation speed OMG0 of the crankshaft 21. The long-period undulation NE0 is the average rotation speed of rotation speeds OMG in the 360-degree crank angle zone H0' including the "0" position. The rotation speed at the "2" position is a rotation speed (DM) obtained by removal of a long-period undulation NE2 from a rotation speed OMG2 of the crankshaft 21. The long-period undulation NE2 is the average rotation speed of rotation speeds OMG in the 360-degree crank angle zone H2' including the "2" position. In more detail, the long-period undulation NE is the average rotation speed of rotation speeds OMG' at the respective detection angles shown in FIG. 4.

The second fluctuation amount is a difference between the rotation speed at the "3" position and the rotation speed at the "5" position. The rotation speed at the "3" position is a rotation speed obtained by removal of a long-period undulation NE3 from a rotation speed OMG3 of the crankshaft 21. The long-period undulation NE3 is the average rotation speed of rotation speeds OMG in the 360-degree crank angle zone H3' including the "3" position. The rotation speed at the "5" position is a rotation speed obtained by removal of a long-period undulation NE5 from a rotation speed OMG5 of the crankshaft 21. The long-period undulation NE5 is the average rotation speed of rotation speeds OMG in the 360-degree crank angle zone H5' including the "5" position.

[Third Embodiment]

Next, a third embodiment of the present teaching will be described. In the following description of the third embodiment, configurations equivalent to those of the above-described first embodiment will be denoted by the same reference signs, and differences from the first embodiment will mainly be described.

Figure 8:
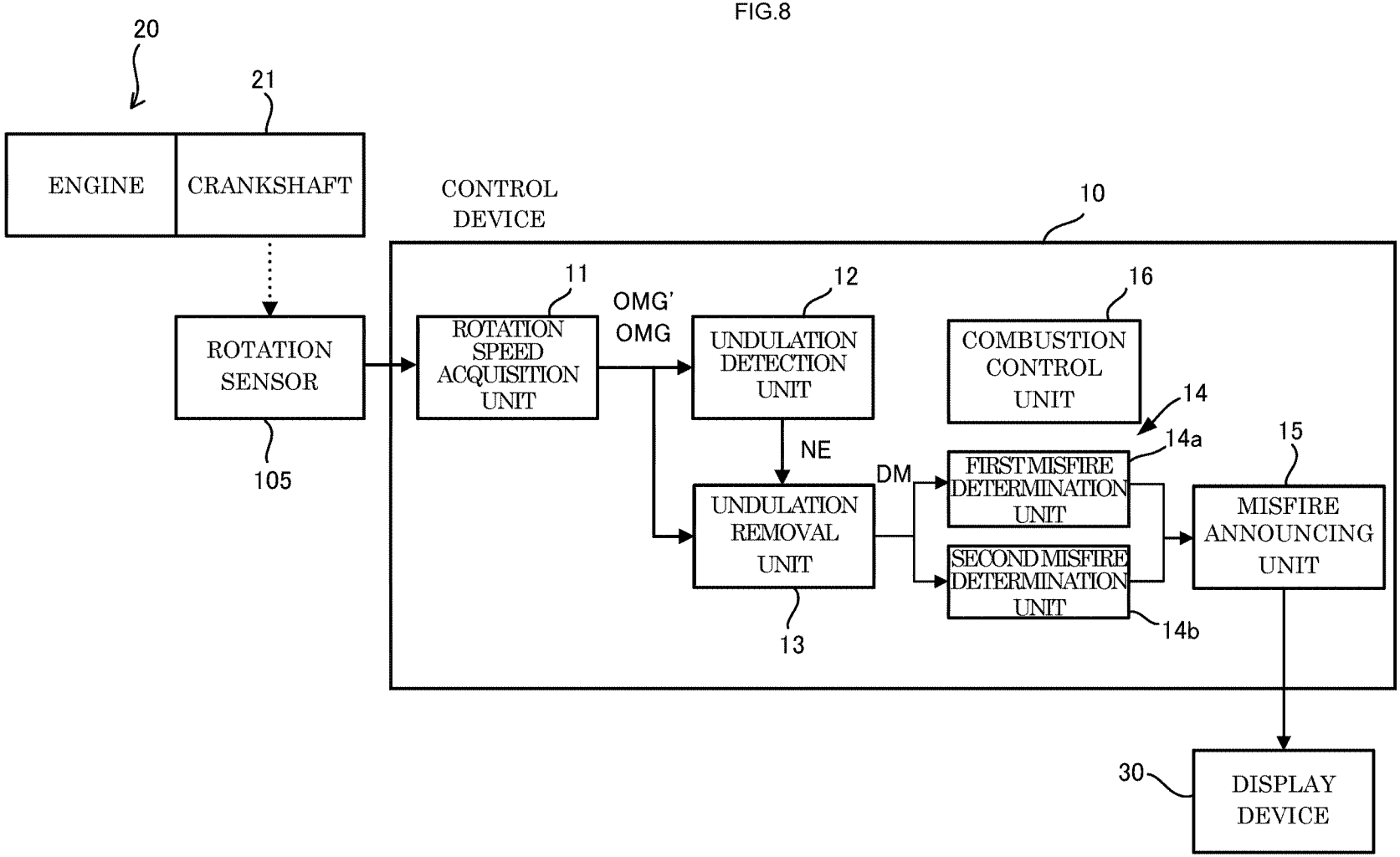
FIG. 8 shows a block diagram showing a configuration of a control device according to a third embodiment of the present teaching.

FIG. 8 is a block diagram showing a configuration of a control device 10 according to the third embodiment of the present teaching.

The control device 10 shown in FIG. 8 includes two misfire determination units 14*a*, 14*b*. A misfire determination unit of the control device 10 includes two misfire determination units 14*a*, 14*b* configured to determine the presence or absence of a misfire in the engine 20 based on rotation fluctuations in different crank angle zones.

The first misfire determination unit 14*a* has the same configuration as that of the misfire determination unit 14 of the first embodiment. The first misfire determination unit 14*a* determines the presence or absence of a misfire based on a change of the amount of fluctuation in the rotation speed after passing a first crank angle zone. In this embodiment, the first crank angle zone has 720 degrees.

To be specific, the first misfire determination unit 14*a* calculates the first fluctuation amount by calculating a difference between rotation speeds in cylinders in which the same stroke successively occurs. The first misfire determination unit 14*a* obtains the second fluctuation amount by calculating a difference between rotation speeds in cylinders in which the same stroke successively occurs at positions 720 crank-angle degrees before the positions of the crankshaft 21 where the first fluctuation amount is calculated. The first misfire determination unit 14*a* determines the presence or absence of a misfire based on a change between the first fluctuation amount and the second fluctuation amount.

The second misfire determination unit 14*b* has the same configuration as that of the misfire determination unit 14 of the second embodiment. The second misfire determination unit 14*b* determines the presence or absence of a misfire based on a change of the amount of fluctuation in the rotation speed after passing a second crank angle zone. The second crank angle zone is different from the first crank angle zone. In this embodiment, the second crank angle zone has 360 crank-angle degrees.

To be specific, the second misfire determination unit 14*b* calculates the second fluctuation amount by calculating a difference between rotation speeds in cylinders in which the same stroke successively occurs. The second misfire determination unit 14*b* obtains the second fluctuation amount by calculating a difference between rotation speeds in cylinders in which the same stroke successively occurs at positions 360 crank-angle degrees before the positions of the crankshaft 21 where the first fluctuation amount is calculated. The second misfire determination unit 14*b* determines the presence or absence of a misfire based on a change from the first fluctuation amount to the second fluctuation amount.

The undulation removal unit 13 of this embodiment outputs the rotation speed obtained by removal of a periodic undulation to both the first misfire determination unit 14*a* and the second misfire determination unit 14*b*. The rotation speed outputted to the first misfire determination unit 14*a* and the second misfire determination unit 14*b* is a rotation speed obtained by removal of the periodic undulation based on a calculation of the average rotation speed of the engine 20 in the same crank angle zone. More specifically, the undulation detection unit 12 detects a long-period undulation by calculating the average rotation speed of the engine 20 in a 720-degree crank angle zone. The undulation removal unit 13 outputs the rotation speed obtained as a result of removal of the long-period undulation detected by the undulation detection unit 12 to both the first misfire determination unit 14*a* and the second misfire determination unit 14*b*. That is, the undulation removal unit 13 outputs the rotation speed, which is obtained as a result of removal of the long-period undulation based on a calculation of the average rotation speed of the engine 20 in the 720-degree crank angle zone, to both the first misfire determination unit 14*a* and the second misfire determination unit 14*b*.

The misfire announcing unit 15 announces the presence or absence of a misfire as determined by both the first misfire determination unit 14*a* and the second misfire determination unit 14*b*. If either the first misfire determination unit 14*a* or the second misfire determination unit 14*b* determines the presence of a misfire, the misfire announcing unit 15 directs the display device 30 to display the presence of a misfire.

In the control device 10 of the third embodiment, the first misfire determination unit 14*a* and the second misfire determination unit 14*b* determine the presence or absence of a misfire based on a change of fluctuation in the rotation speed after passing different crank angle zones. Accordingly, the accuracy of misfire determination is increased.

The undulation removal unit 13 outputs the rotation speed obtained as a result of removal of the long-period undulation to both the first misfire determination unit 14*a* and the second misfire determination unit 14*b*. The undulation removal unit 13 outputs a rotation speed to both the first misfire determination unit 14*a* and the second misfire determination unit 14*b*, the rotation speed being obtained as a result of removal of the long-period undulation based on a calculation of the average rotation speed in the same crank angle zone. A fluctuation in the rotation speed attributable to a misfire is a fluctuation attributable to an internal factor of the engine 20. The long-period undulation is a fluctuation attributable to an external factor of the engine 20.

The undulation detection unit 12 and the undulation removal unit 13 calculate the average rotation speed under a condition which is common to both the first misfire determination unit 14*a* and the second misfire determination unit 14*b*. Therefore, the long-period undulation attributable to the external factor of the engine 20 is removed under a condition which is common to both the first misfire determination unit 14*a* and the second misfire determination unit 14*b*.

The removal of the long-period undulation attributable to the external factor of the engine 20 is performed under the common condition, while detection of the fluctuation attributable to the internal factor of the engine 20 is performed under different kinds of conditions. Accordingly, the accuracy of detection of a misfire associated with the internal factor of the engine 20 is increased.

The undulation removal unit 13 of this embodiment removes the long-period undulation based on a calculation of the average rotation speed in the 720-degree crank angle zone. The fluctuation in the rotation speed attributable to a misfire has a period shorter than 720 crank-angle degrees. A relatively rapid fluctuation in the rotation speed attributable to a misfire is less easily suppressed by the undulation removal unit 13 of this embodiment. The accuracy of detection of a misfire is further increased.

[Motorcycle]

Figure 9:
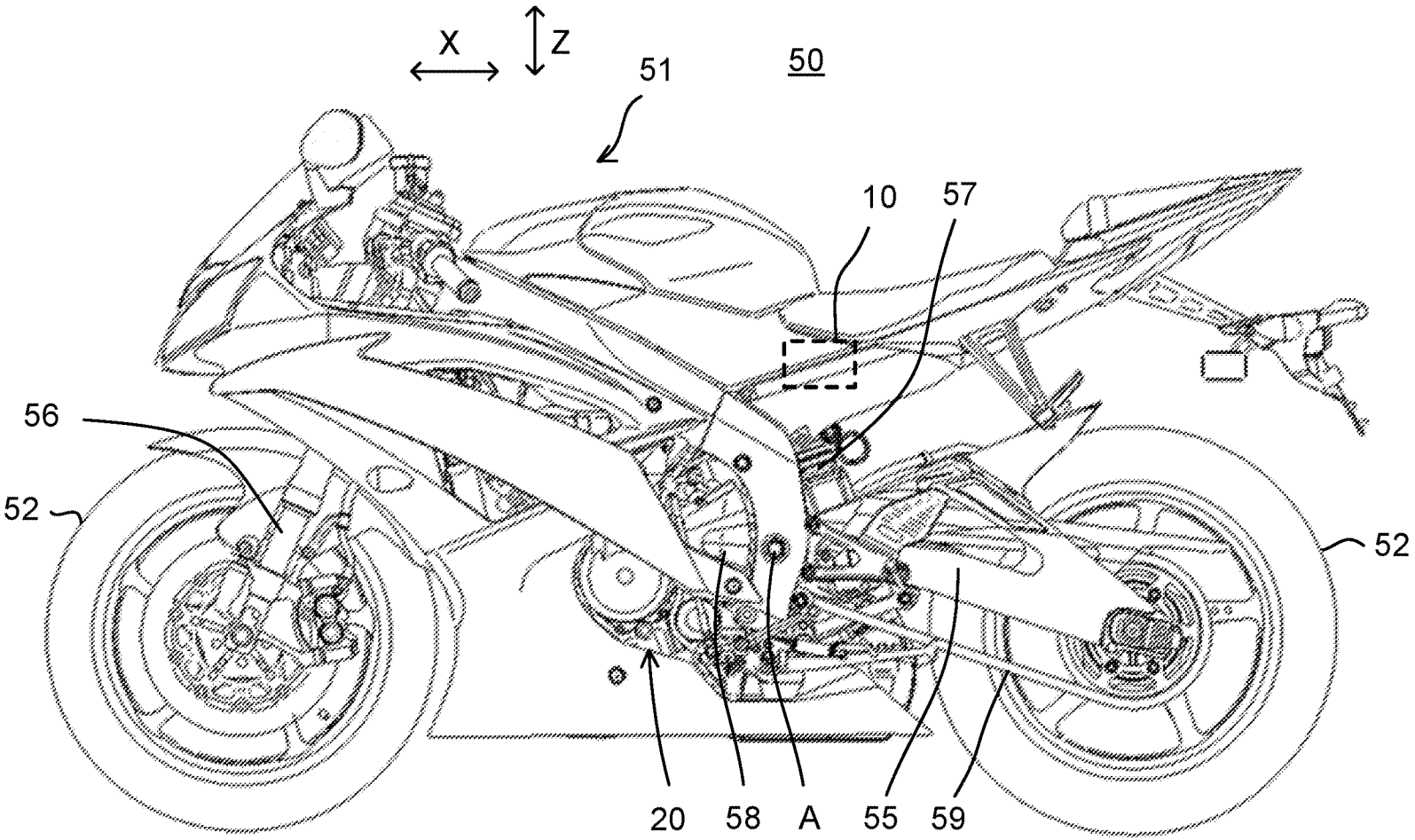
FIG. 9 shows a diagram showing an external appearance of a motorcycle equipped with the control device according to any of the first to third embodiments.

FIG. 9 is a diagram showing an external appearance of a motorcycle equipped with the control device 10 according to any of the first to third embodiments.

The motorcycle 50 shown in FIG. 9 includes a vehicle body 51 and two wheels 52. The vehicle body 51 supports the wheels 52. The two wheels 52 provided to the vehicle body 51 of the motorcycle 50 are arranged side by side in a front-rear direction X of the motorcycle 50. The vehicle body 51 includes suspensions 56, 57. The wheels 52 are supported by the suspensions 56, 57. The vehicle body 51 has a swing arm 55 that is swingable in a vertical direction Z about a shaft A extending in a lateral direction of the vehicle body 51. The swing arm 55, at its end opposite to the shaft A, supports the rear wheel 52. Thus, the rear wheel 52 is supported so as to be swingable in the vertical direction Z about the shaft A extending in the lateral direction of the vehicle body 51.

The vehicle body 51 is provided with the control device 10 and the four-stroke engine 20 (engine 20). The engine 20 drives the wheel 52. A driving force of the engine 20 is transmitted to the wheel 52 through a transmission 58 and a chain 59. The motorcycle 50 does not include a pair of left and right drive wheels, and does not include a differential gear which would be provided to a drive wheel of a general automobile, etc.

The control device 10 controls the engine 20. The control device 10 detects a misfire in the engine 20 based on the rotation speed of the crankshaft 21 (see FIG. 1) rotated by the engine 20.

More specifically, the rotation speed acquisition unit 11 (see FIG. 2) of the control device 10 obtains the rotation speed of the crankshaft 21 rotated by the engine 20. Based on the rotation speed obtained by the rotation speed acquisition unit 11, the undulation detection unit 12 (see FIG. 2) of the control device 10 detects a long-period undulation contained in the rotation speed of the engine 20 that drives the wheel 52.

A fluctuation in the rotation speed of the engine 20 contains a fluctuation attributable to combustion of the engine 20. The fluctuation attributable to combustion of the engine 20 has an angular period shorter than the crank angle corresponding to four strokes. The fluctuation in the rotation speed of the engine 20 contains not only the fluctuation attributable to combustion of the engine 20 but also a fluctuation attributable to an external factor of the engine, such as the structure of the motorcycle 50. The fluctuation attributable to the structure of the motorcycle 50, etc. occurs even while the motorcycle 50 is traveling on a flat road as well as on a rough road. The fluctuation attributable to the structure of the motorcycle 50, etc. contains a long-period undulation whose angular period is longer than the crank angle corresponding to four strokes of the motorcycle 50.

Depending on the kind of structure of the motorcycle 50, etc., at least a part of the long-period undulation attributable to the structure of the motorcycle 50, etc. is highly correlated with a fluctuation in the amount of extension and compression of the suspensions 56, 57. Such a long-period undulation is caused also when, for example, a wheel balance of the wheel 52, which means a weight balance of the wheels 52 with respect to the circumferential direction, is lost.

The control device 10 of this embodiment is able to detect a long-period undulation contained in the rotation speed of the engine 20 by means of the rotation speed acquisition unit 11 and the undulation detection unit 12. The control device 10, therefore, is able to obtain a rotation fluctuation attributable to combustion of the engine 20 by directing the undulation removal unit 13 to remove the long-period undulation from the rotation speed of the engine 20. As a result, the control device 10 is able to accurately detect the presence or absence of a misfire in the engine 20 while suppressing an influence of the long-period undulation.

As thus far described, the control device 10 of this embodiment is applicable also to the motorcycle 50 having a long-period undulation contained in the rotation speed.

[Method of Verification in Misfire Determination]

A description will now be given of a first method for verifying that the control device 10 of this embodiment suppresses erroneous determination of a misfire in the engine 20 even when the rotation speed of the engine 20 contains a long-period undulation whose angular period is longer than the crank angle corresponding to four strokes.

A motorcycle capable of detecting an engine misfire is installed on a chassis dynamometer, and travel is simulated on the chassis dynamometer. Traveling conditions are that steady traveling is made at 80 km/h or more and less than 100 km/h in the case of the amount of emission of the motorcycle being 250 cc or more whereas steady traveling is made at 30 km/h or more and less than 50 km/h in the case of the amount of emission of the motorcycle being less than 250 cc.

It is confirmed that no misfire is detected while travel of the motorcycle 50 is simulated.

Then, a weight is attached to a wheel outer circumferential portion of the wheel 52 of the motorcycle 50, for spoiling a weight balance of the wheels. The weight is a weight that is generally adopted for ensuring a wheel balance. For example, a weight of more than 50 g is adopted as the weight. Travel of the motorcycle with the weight attached is simulated at the maximum speed mentioned above. It is confirmed that no misfire is detected while travel of the motorcycle is simulated. In a case where the control device 10 of this embodiment is in operation, the control device does not detect a misfire although the weight is attached to the wheel 52 of the motorcycle 50.

Since the weight is attached to the wheel of the motorcycle, a control device that does not have any function corresponding to the function of the undulation detection unit 12 of this embodiment would erroneously determine the presence of a misfire though actually no misfire is occurring in the engine.

Next, a second method for verifying suppression of erroneous determination of a misfire will be described. The second method is applicable to vehicles other than motorcycles.

Traveling conditions in the second method are different from the traveling conditions in the first method described above. In the second method, an engine provided in a vehicle is rotated in a middle rotation frequency range. The middle rotation frequency range is a middle range among three ranges, namely, high, middle, and low rotation frequency ranges, which are obtained by dividing the rated value of the rotation frequency of the engine equally into three regions. The rest of the process of the second method is the same as that of the first method described above.

Next, a third method for verifying suppression of erroneous determination of a misfire will be described. The third method is also applicable to vehicles other than motorcycles.

Traveling conditions in the third method are different from the traveling conditions in the first method described above. In the third method, an engine provided in a vehicle is rotated in a middle torque range. The middle torque range is a middle range among three ranges, namely, high, middle, and low output torque ranges, which are obtained by dividing the rated output torque value of the engine equally into three regions. The rest of the process is the same as that of the first method described above.

In the embodiments described above, the undulation detection unit 12 that calculates the average rotation speed of the engine 20 in a 360-degree crank angle zone or a 720-degree crank angle zone is illustrated as an example of the undulation detection unit. This does not limit the control device of the present teaching. For example, the undulation detection unit may be configured to detect a long-period undulation by calculating the average rotation speed in a crank angle zone of more than 720 degrees.

Of the embodiments described above, the first embodiment illustrates the configuration in which: the undulation detection unit 12 calculates the average rotation speed in a 720-degree crank angle zone; and the misfire determination unit 14 calculates a difference between rotation speeds in cylinders in which the same stroke successively occurs at positions 720 crank-angle degrees before the positions of the crankshaft 21 where the first fluctuation amount is calculated. The second embodiment illustrates the configuration in which: the undulation detection unit 12 calculates the average rotation speed in a 360-degree crank angle zone; and the misfire determination unit 14 calculates a difference between rotation speeds in cylinders in which the same stroke successively occurs at positions 360 crank-angle degrees before the positions of the crankshaft 21 where the first fluctuation amount is calculated. In the present teaching, however, it may not always be necessary that the zone in which the undulation detection unit calculates the average rotation speed is coincident with a distance between target positions for which the first and second fluctuation amounts are respectively calculated by the misfire determination unit.

In the present teaching, the zone in which the undulation detection unit calculates the average rotation speed is not limited to 720 crank-angle degrees or 360 crank-angle degrees, and it suffices that the zone has 360 crank-angle degrees or more. The zone in which the undulation detection unit calculates the average rotation speed may have 360m crank-angle degrees (m is a natural number), for example.

Of the embodiments described above, the third embodiment illustrates the configuration in which: the undulation detection unit 12 detects a long-period undulation by calculating the average rotation speed in a 720-degree crank angle zone; and the undulation removal unit 13 outputs the rotation speed obtained as a result of removal of the detected long-period undulation to both the first misfire determination unit 14*a* and the second misfire determination unit 14*b*. Thus, the rotation speed obtained as a result of removal of the long-period undulation based on a calculation of the average rotation speed in the same zone is outputted to both the first misfire determination unit 14*a* and the second misfire determination unit 14*b*.

This, however, does not limit the control device of the present teaching. For example, the undulation detection unit and the undulation removal unit may output two types of rotation speeds obtained as a result of removal of long-period undulations based on a calculation of the average rotation speeds in different zones. In this case, different types of rotation speeds are outputted to the first misfire determination unit 14*a* and the second misfire determination unit 14*b*, respectively.

The undulation detection unit may be configured to detect a long-period undulation by calculating the average rotation speed in a (360×m)-degree crank angle zone, and to detect a long-period undulation by calculating the average rotation speed in a (360×n)-degree crank angle zone, where n represents a natural number different from m. For example, the undulation detection unit may be configured to detect a long-period undulation by calculating the average rotation speed in a 360-degree crank angle zone, and to detect a long-period undulation by calculating the average rotation speed in a 720-degree crank angle zone. Since the long-period undulations are detected under different conditions, a wider range of the long-period undulation can be detected.

In the embodiments described above, a control device for a three-cylinder engine is illustrated as an example of the control device. The control device of the present teaching, however, is not limited thereto but may be a control device for a single-cylinder engine. In a case of a single-cylinder engine, the same cylinder is meant by the aforesaid "cylinders in which the same stroke successively occurs". The control device of the present teaching may be a control device for a two-cylinder engine or an engine including four or more cylinders. For example, a control device for an engine of even-interval explosion type including an even number of cylinders suppresses a 360-degree crank angle fluctuation specific to each zone as a result of a calculation of the average rotation speed in a 360-degree crank angle zone. Accordingly, a long-period undulation can be detected with a further increased accuracy.

In the embodiments described above, the control device 10 including the misfire determination unit 14 is illustrated as an example of the control device. The control device of the present teaching is not limited thereto but may be a device not including the misfire determination unit 14. The control device of the present teaching may be, for example, a device configured to output outside the rotation speed obtained as a result of removal of a long-period undulation. The control device of the present teaching may be, for example, a device configured to detect an unevenness of combustion among cylinders based on the rotation speed obtained as a result of removal of a long-period undulation. That is, the control device of the present teaching may control a four-stroke engine, may diagnose a four-stroke engine, or may monitor an operating state of a four-stroke engine.

The undulation removal unit is not limited to the one configured to remove a long-period undulation from the engine rotation speed after the undulation detection unit detects the long-period undulation. For example, processing for detection of a long-period undulation and processing for removal of the long-period undulation may be performed collectively in an arithmetic operation based on a single expression. Moreover, at least part of processing for the determination of the presence or absence of a misfire, processing for detection of a long-period undulation, and processing for removal of the long-period undulation may be performed collectively in an arithmetic operation based on a single expression.

In the embodiments described above, the control device 10 configured to detect a long-period undulation contained in the rotation speed of the engine 20 that drives the wheel of the motorcycle 50 is illustrated as an example of the control device. The control device of the present teaching is not limited thereto but may be applied to a vehicle including a wheel. For example, the control device of the present teaching may be applied to straddled vehicles including three-wheel vehicles or four-wheel vehicles. The control device of the present teaching may be applied to a four-wheel vehicle having a cabin. The control device of the present teaching may be applied to a vehicle with an engine for driving a propulsion unit other than a wheel. A vehicle to which the control device of the present teaching is applied may be either a manned vehicle or an unmanned transport system.

The control device of the present teaching may be applied to, for example, an outboard motor with a propeller that is driven by an engine. The control device of the present teaching may be applied to, for example, an apparatus other than vehicles, such as power generating equipment including a power generator that is driven by an engine. Also in an apparatus such as the outboard motor or the power generating equipment, accurate announcement of a misfire is achieved, which enables components such as a catalyst to be protected appropriately.

It should be understood that the terms and expressions used in the above embodiments are for description and not to be construed in a limited manner, do not eliminate any equivalents of features shown and mentioned herein, and allow various modifications falling within the claimed scope of the present teaching. The present teaching may be embodied in many different forms. The present disclosure is to be considered as providing embodiments of the principles of the invention. The embodiments are described herein with the understanding that such embodiments are not intended to limit the invention to preferred embodiments described herein and/or illustrated herein. The embodiments described herein are not limiting. The present teaching includes any and all embodiments having equivalent elements, modifications, omissions, combinations, adaptations and/or alterations as would be appreciated by those in the art based on the present disclosure. The limitations in the claims are to be interpreted broadly based on the language employed in the claims and not limited to embodiments described in the present specification or during the prosecution of the present application. The present teaching is to be interpreted broadly based on the language employed in the claims.

REFERENCE SIGNS LIST

10 control device
11 rotation speed acquisition unit
12 undulation detection unit
13 undulation removal unit
14 (14*a*, 14*b*) misfire determination unit
15 misfire announcing unit
20 engine
21 crankshaft
50 motorcycle
51 vehicle body
52 wheel
56, 57 suspension

What is claimed is:

1. A control device for a rotating element that is rotated by a four-stroke engine,the control device comprising:

a rotation speed acquisition unit configured to obtain a rotation speed of the rotating element rotated by the four-stroke engine;

an undulation detection unit configured to, based on the rotation speed obtained by the rotation speed acquisition unit, detect a periodic undulation contained in a rotation fluctuation of the four-stroke engine, the periodic undulation having an angular period longer than a crank angle corresponding to four strokes; and an undulation removal unit configured to remove the periodic undulation detected by the undulation detection unit from a rotation speed of the four-stroke engine obtained based on the rotation speed of the rotating element;

wherein the undulation detection unit is configured to detect the periodic undulation by repeatedly calculating an average rotation speed of the four-stroke engine in a (360×m)-degree crank angle zone, where m represents a natural number, based on the rotation speed obtained by the rotation speed acquisition unit.

2. The control device according to claim 1, wherein the undulation detection unit is configured to detect the periodic undulation by repeatedly calculating an average rotation speed of the four-stroke engine in a 360-degree crank angle zone based on the rotation speed obtained by the rotation speed acquisition unit.

3. The control device according to claim 1, wherein the undulation detection unit is configured to detect the periodic undulation by repeatedly calculating an average rotation speed of the four-stroke engine in a 720-degree crank angle zone based on the rotation speed obtained by the rotation speed acquisition unit.

4. The control device according to claim 1, wherein the undulation detection unit is configured to detect the periodic undulation by repeatedly calculating an average rotation speed of the four-stroke engine in a (360×m)-degree crank angle zone and to detect the periodic undulation by repeatedly calculating the average rotation speed of the four-stroke engine in a (360×n)-degree crank angle zone, where n represents a natural number different from m, based on the rotation speed obtained by the rotation speed acquisition unit.

5. The control device according to claim 1, wherein the undulation detection unit is configured to detect a component of the periodic undulation at a detection target crank angle position, based on a rotation speed in a range from a crank angle position before the detection target crank angle position to a crank angle position after the detection target crank angle position, the rotation speed in the range being obtained by the rotation speed acquisition unit.

6. The control device according to any one of claims 1 or 2 to 5, wherein the rotation speed acquisition unit is configured to obtain a rotation speed of the rotating element included in a vehicle, the rotating element being rotated by the four-stroke engine that is provided in the vehicle so as to drive the vehicle, and the undulation detection unit is configured to detect the periodic undulation contained in a rotation speed of the four-stroke engine provided in the vehicle, based on the rotation speed obtained by the rotation speed acquisition unit.

7. The control device according to claim 6, wherein the rotation speed acquisition unit is configured to obtain a rotation speed of the rotating element rotated by the four-stroke engine that is provided in the vehicle so as to drive a wheel of the vehicle, and the undulation detection unit is configured to detect the periodic undulation contained in a rotation speed of the four-stroke engine that drives the wheel, based on the rotation speed obtained by the rotation speed acquisition unit.

8. The control device according to claim 7, wherein the rotation speed acquisition unit is configured to obtain a rotation speed of the rotating element rotated by the four-stroke engine for driving the wheel that is supported by a suspension of the vehicle so as to be swingable in a vertical direction about a shaft extending in a lateral direction of a vehicle body of the vehicle, and the undulation detection unit is configured to detect the periodic undulation contained in a rotation speed of the four-stroke engine for driving the wheel that is supported to the vehicle body in a front-rear direction so as to be swingable in the vertical direction by the suspension, based on the rotation speed obtained by the rotation speed acquisition unit.

9. The control device according to any one of claims 1 or 2 to 5, wherein the control device further comprises at least one misfire determination unit configured to determine a presence or absence of a misfire in the four-stroke engine based on a rotation fluctuation attributable to combustion of the four-stroke engine, the rotation fluctuation attributable to combustion of the four-stroke engine being obtained by removal of a periodic undulation detected by the undulation detection unit from the rotation speed of the four-stroke engine.

10. The control device according to claim 9, wherein the at least one misfire determination unit includes two misfire determination units configured to determine the presence or absence of a misfire in the four-stroke engine based on rotation fluctuations in different crank angle zones, respectively, and the two misfire determination units determine the presence or absence of a misfire in the four-stroke engine based on rotation fluctuations each obtained by removal of a periodic undulation from the rotation speed of the four-stroke engine, the periodic undulation being detected by the undulation detection unit calculating the average rotation speed in a same crank angle zone.

11. The control device according to claim 9, wherein the rotation speed acquisition unit is configured to obtain a rotation speed of the rotating element included in a vehicle, the rotating element being rotated by the four-stroke engine that is provided in the vehicle so as to drive the vehicle, and the undulation detection unit is configured to detect the periodic undulation contained in a rotation speed of the four-stroke engine provided in the vehicle, based on the rotation speed obtained by the rotation speed acquisition unit.

12. The control device according to claim 11, wherein the rotation speed acquisition unit is configured to obtain a rotation speed of the rotating element rotated by the four-stroke engine that is provided in the vehicle so as to drive a wheel of the vehicle, and the undulation detection unit is configured to detect the periodic undulation contained in a rotation speed of the four-stroke engine that drives the wheel, based on a rotation speed obtained by the rotation speed acquisition unit.

13. The control device according to claim 12, wherein the rotation speed acquisition unit is configured to obtain a rotation speed of the rotating element rotated by the four-stroke engine for driving the wheel that is supported by a suspension of the vehicle so as to be swingable in a vertical direction about a shaft extending in a lateral direction of a vehicle body of the vehicle, and the undulation detection unit is configured to detect the periodic undulation contained in a rotation speed of the four-stroke engine for driving the wheel that is supported to the vehicle body in a front-rear direction so as to be swingable in the vertical direction by the suspension, based on the rotation speed obtained by the rotation speed acquisition unit.

14. The control device according to claim 10, wherein the rotation speed acquisition unit is configured to obtain a rotation speed of the rotating element included in a vehicle, the rotating element being rotated by the four-stroke engine that is provided in the vehicle so as to drive the vehicle, and the undulation detection unit is configured to detect the periodic undulation contained in a rotation speed of the four-stroke engine provided in the vehicle, based on the rotation speed obtained by the rotation speed acquisition unit.

15. The control device according to claim 14, wherein the rotation speed acquisition unit is configured to obtain a rotation speed of the rotating element rotated by the four-stroke engine that is provided in the vehicle so as to drive a wheel of the vehicle, and the undulation detection unit is configured to detect the periodic undulation contained in a rotation speed of the four-stroke engine that drives the wheel, based on the rotation speed obtained by the rotation speed acquisition unit.

16. The control device according to claim 15, wherein the rotation speed acquisition unit is configured to obtain a rotation speed of the rotating element rotated by the four-stroke engine for driving the wheel that is supported by a suspension of the vehicle so as to be swingable in a vertical direction about a shaft extending in a lateral direction of a vehicle body of the vehicle, and the undulation detection unit is configured to detect the periodic undulation contained in a rotation speed of the four-stroke engine for driving the wheel that is supported to the vehicle body in a front-rear direction so as to be swingable in the vertical direction by the suspension, based on the rotation speed obtained by the rotation speed acquisition unit.

* * * * *